US011293220B2

(12) United States Patent
Cheng

(10) Patent No.: US 11,293,220 B2
(45) Date of Patent: Apr. 5, 2022

(54) CONTROLLER ASSEMBLY FOR WINDOW BLIND

(71) Applicant: Ching-Hsiang Cheng, Tainan (TW)

(72) Inventor: Ching-Hsiang Cheng, Tainan (TW)

( * ) Notice: Subject to any disclaimer, the term of this patent is extended or adjusted under 35 U.S.C. 154(b) by 74 days.

(21) Appl. No.: 17/025,920

(22) Filed: Sep. 18, 2020

(65) Prior Publication Data

US 2021/0087879 A1 Mar. 25, 2021

(30) Foreign Application Priority Data

Sep. 20, 2019 (TW) ..... 108134068

(51) Int. Cl.
*E06B 9/322* (2006.01)

(52) U.S. Cl.
CPC ..... *E06B 9/322* (2013.01)

(58) Field of Classification Search
CPC ..... E06B 9/322; E06B 9/42
USPC ..... 160/170
See application file for complete search history.

(56) References Cited

U.S. PATENT DOCUMENTS 1,896,623 A * 2/1933 Hixon ..... E06B 9/70 160/120
4,079,597 A * 3/1978 Lindner ..... E06B 9/72 192/142 R
4,869,308 A * 9/1989 Chang ..... E06B 9/307 160/176.1 R

FOREIGN PATENT DOCUMENTS

| | | | | |
|---|---|---|---|---|
| DE | 102006060973 A1 * | 7/2008 | ..... | E06B 9/32 |
| EP | 1936092 A2 * | 6/2008 | ..... | E06B 9/32 |
| EP | 3795795 A1 * | 3/2021 | ..... | E06B 9/322 |
| JP | S5174448 * | 6/1976 | ..... | E06B 9/32 |
| JP | 08165870 A * | 6/1996 | | |
| JP | 2001173341 A * | 6/2001 | | |
| JP | 2006200153 A * | 8/2006 | | |
| JP | 2015055132 A * | 3/2015 | ..... | E06B 9/322 |
| JP | 2018071198 A * | 5/2018 | | |
| JP | 6808448 B2 * | 1/2021 | | |

* cited by examiner

*Primary Examiner* — Beth A Stephan

(74) *Attorney, Agent, or Firm* — Muncy, Geissler, Olds & Lowe, P.C.

(57) ABSTRACT

A controller assembly for a window blind includes a drive mechanism and at least one transmission mechanism with a gear unit and a transmission unit. When the gear unit is driven by the drive mechanism to operate, first and second major gears thereof rotate in two opposite rotational directions. The transmission unit is selectively coupled to rotate with a selected one of the first and second major gears. When the transmission unit is coupled to rotate with one of the first and second major gears, the window blind is driven to wind up. When the transmission unit is coupled to rotate with the other one of the first and second major gears, the window blind is driven to wind down.

20 Claims, 20 Drawing Sheets

CONTROLLER ASSEMBLY FOR WINDOW BLIND

CROSS-REFERENCE TO RELATED APPLICATION

This application claims priority from Taiwanese invention patent application no. 108134068, filed on Sep. 20, 2019.

FIELD

The disclosure relates to a controller fora covering, more particularly to a controller assembly for a window blind.

BACKGROUND

For controlling movement of a window blind, two conventional approaches are provided. In one of the conventional approaches, the window blind may be moved upwardly in response to pulling down of an operating rope. When the operating rope is released, the operating rope may turn back and the window blind may naturally move down due to its gravity. In the other one of the conventional approaches, an endless operating rope is used to control movement of the window blind. The endless operating rope has two rope segments. When one of the rope segments is pulled down, the window blind is driven to move upward. When the other one of the rope segments is pulled down, the window blind is driven to move downward. The operating rope may be accessed by a child and this may result in an accident.

SUMMARY

An object of the disclosure is to provide a novel controller assembly for a window blind which may overcome the drawback of the prior art.

According to the disclosure, a controller assembly for a window blind includes at least one transmission mechanism and a drive mechanism. The transmission mechanism includes a gear unit and a transmission unit. The gear unit includes a first major gear, a second major gear, and an auxiliary gear set. The first and second major gears are coaxially spaced apart from each other along a longitudinal axis. The auxiliary gear set is disposed to couple to both the first and second major gears such that when the gear unit is driven to operate, the first and second major gears rotate respectively in a first rotational direction and a second rotational direction which is opposite to the first rotational direction. The transmission unit is selectively coupled to rotate with a selected one of the first and second major gears. The drive mechanism includes a spool unit and a pulling cord. The spool unit is coupled to the at least one transmission mechanism. The pulling cord is coupled to and wound around the spool unit such that when the pulling cord is actuated to unwind from the spool unit, the gear unit of the least one transmission mechanism is driven to operate.

With the provision of the controller assembly of the disclosure, when the transmission unit is coupled to rotate with one of the first and second major gears, the window blind may wind up in response to pulling of the pulling cord. On the other hand, when the transmission unit is coupled to rotate with the other one of the first and second major gears, the window blind may wind down in response to pulling of the pulling cord.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

Figure 1:
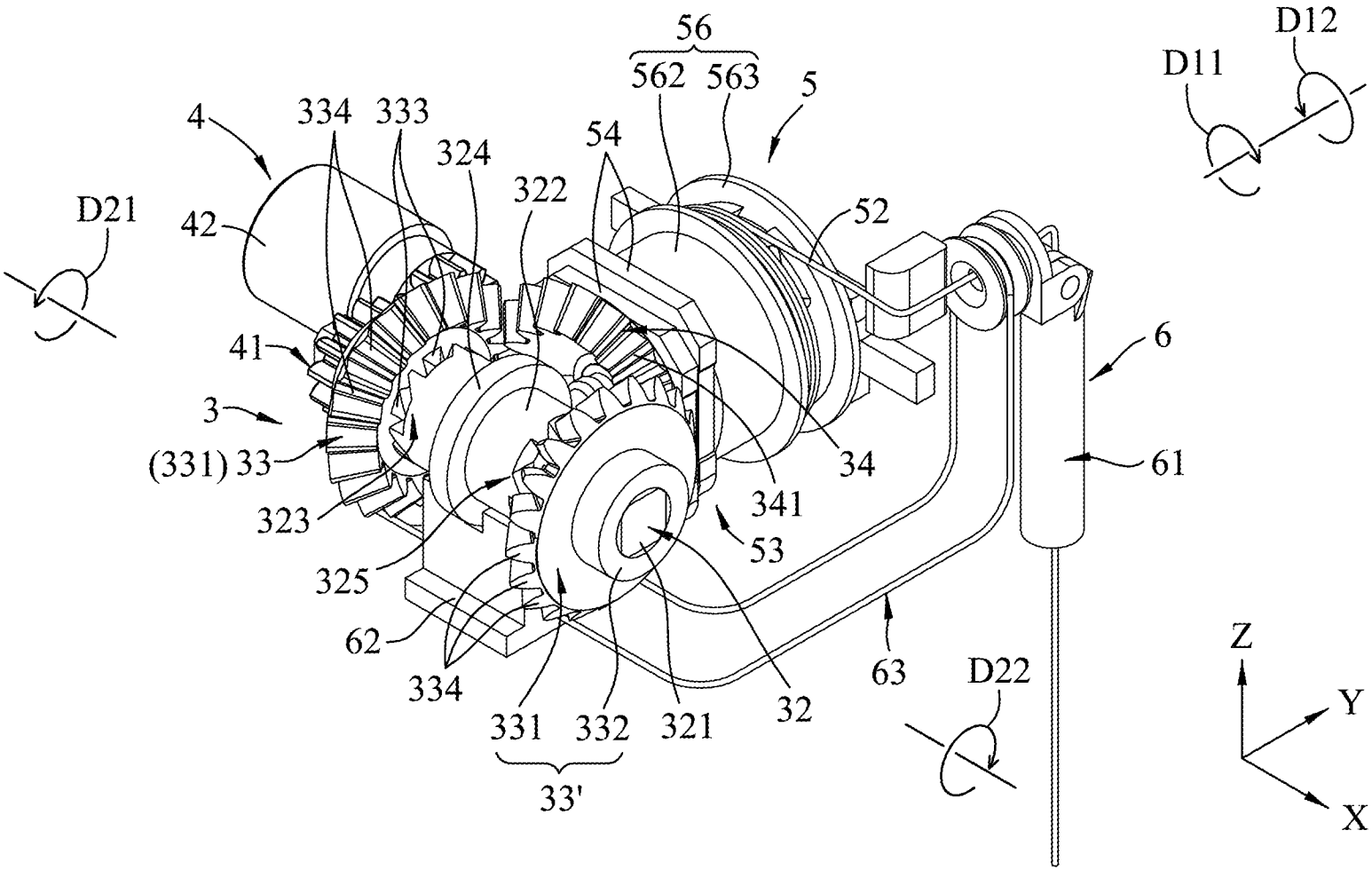
FIG. 1 is a perspective view of a controller assembly according to a first embodiment of the disclosure, in which a housing mechanism is omitted.

Before the disclosure is described in greater detail, it should be noted that where considered appropriate, reference numerals have been repeated among the figures to indicate corresponding or analogous elements, which may optionally have similar characteristics.

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Referring to FIGS. 1 to 4, a controller assembly according to a first embodiment of the disclosure is shown to include at least one transmission mechanism 3 and a drive mechanism 5. The controller assembly may be coupled to drive rotation of a turning axle 1 (see FIG. 4) so as to wind up or wind down a window blind (not shown).

The transmission mechanism 3 includes a gear unit 31 and a transmission unit 32.

The gear unit 31 includes a first major gear 33, a second major gear 33', and an auxiliary gear set 34. The first and second major gears 33, 33' are coaxially spaced apart from each other along a longitudinal axis (L) in a left-right direction (X). The auxiliary gear set 34 is disposed to couple to both the first and second major gears 33, 33' such that when the gear unit 31 is driven to operate, the first and second major gears 33, 33' rotate respectively in a first rotational direction (D21) and a second rotational direction (D22) which is opposite to the first rotational direction (D21).

Figure 2:
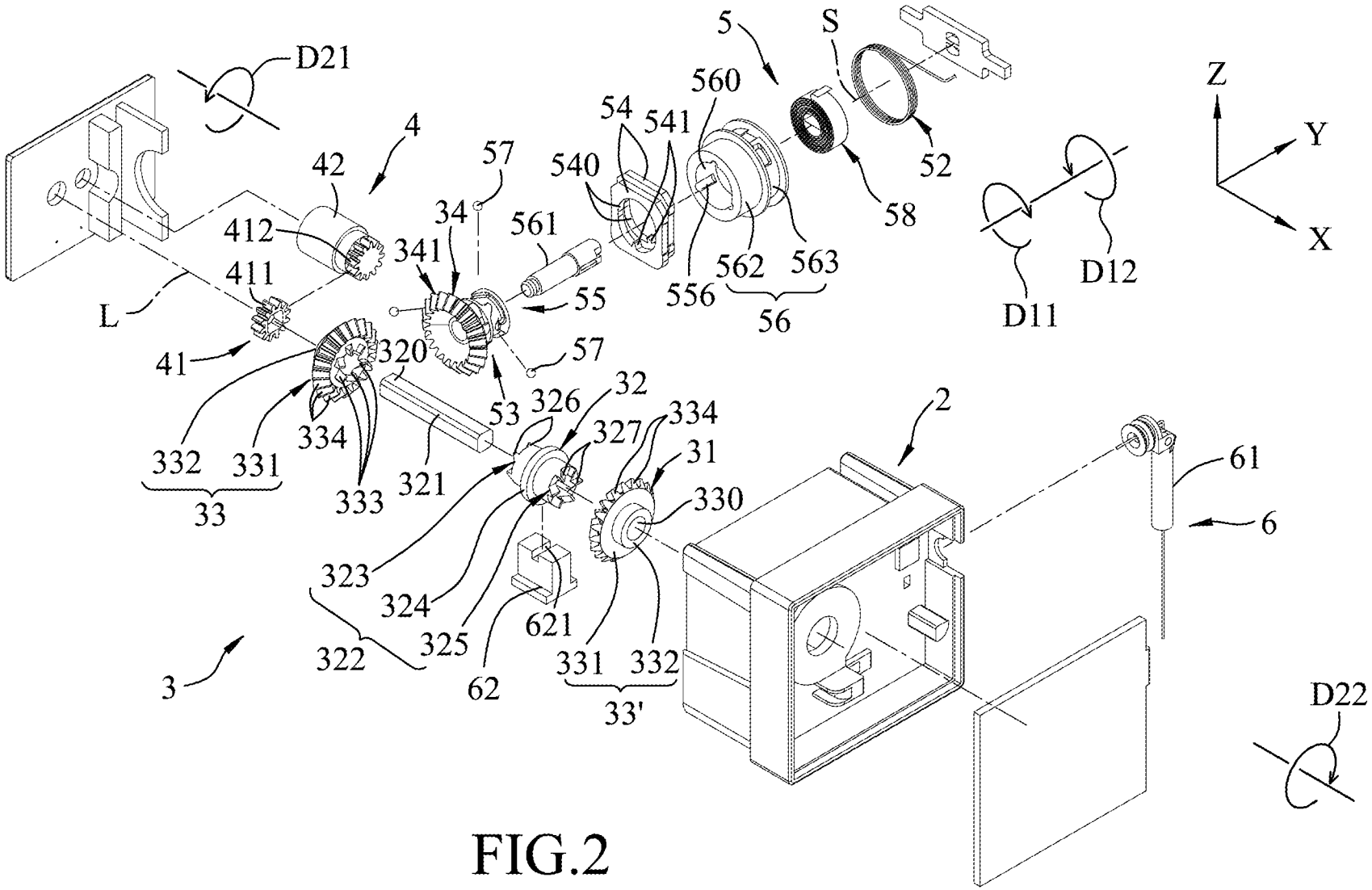
FIG. 2 is an exploded perspective view of the first embodiment in which a first actuating member is omitted.
Figure 3:
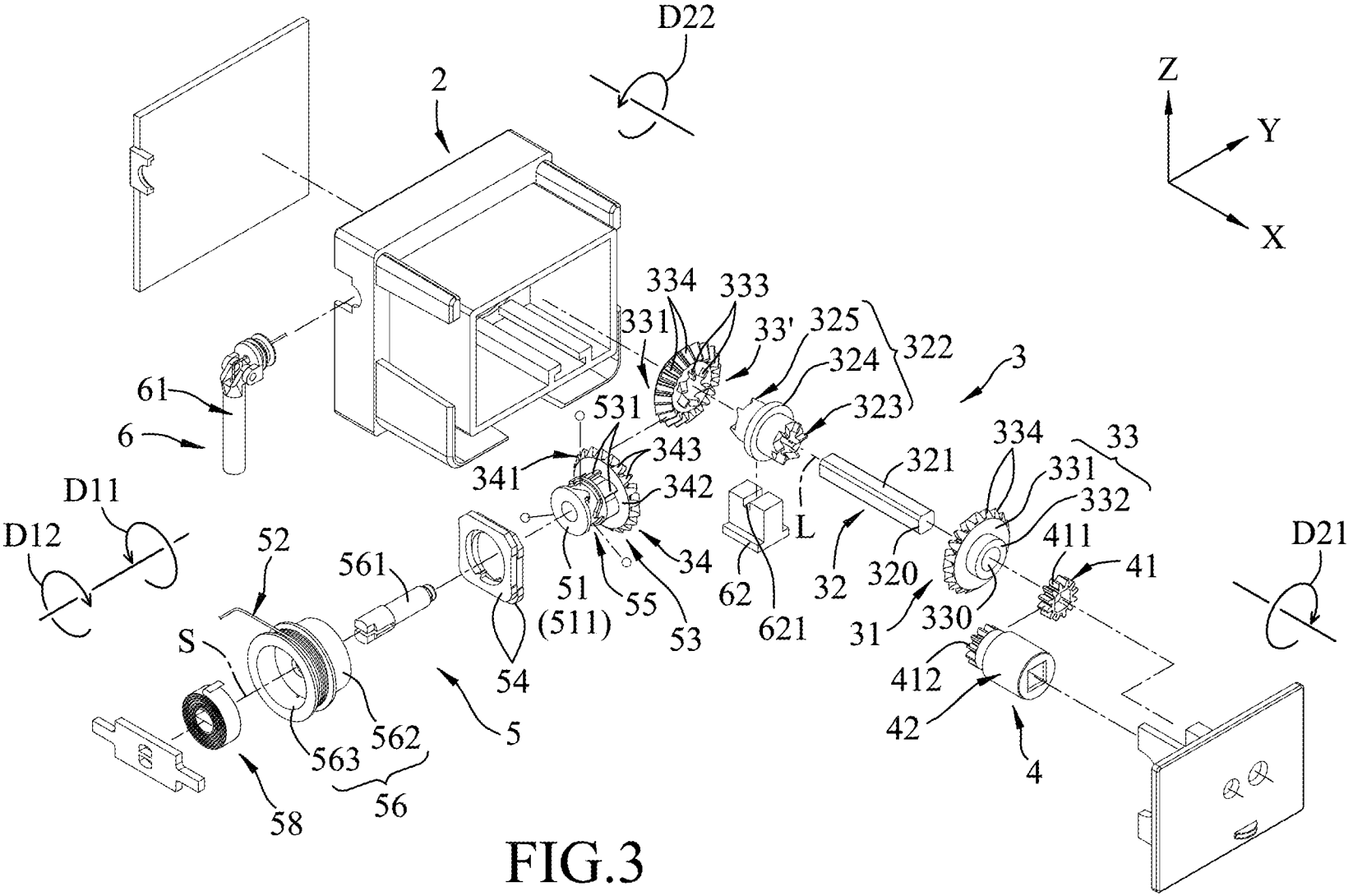
FIG. 3 is similar to FIG. 2 but illustrating at a different angle of view.

In an embodiment shown in FIGS. 2 and 3, each of the first and second major gears 33, 33' may include a plurality of inner mating teeth 333 and a plurality of outer bevel teeth 334, and the auxiliary gear set 34 includes at least one auxiliary bevel gear 341 which is in mesh simultaneously with the outer bevel teeth 334 of the first and second major gears 33, 33' so as to permit the first and second major gears 33, 33' to rotate respectively in the first and second rotational directions (D21, D22).

In an embodiment shown in FIGS. 2 and 3, each of the first and second major gears 33, 33' may include a wheel portion 331 and a tubular portion 332. The wheel portion 331 is opposite to the tubular portion 332 in the left-right direction (X), and has the inner mating teeth 333 and the outer bevel teeth 334. The first major gear 33 is disposed leftward of the second major gear 33' to permit the wheel portions 331 of the first and second major gears 33, 33' to be arranged to confront each other.

In an embodiment shown in FIG. 3, the auxiliary bevel gear 341 may include a central portion 342 and a plurality of auxiliary bevel teeth 343. The auxiliary bevel teeth 343 are angularly displaced from each other about the central portion 342, and are in mesh simultaneously with the outer bevel teeth 334 of the first and second major gears 33, 33' to thereby drive rotations of the first and second major gears 33, 33'.

The transmission unit 32 is selectively coupled to rotate with a selected one of the first and second major gears 33, 33'.

In an embodiment shown in FIGS. 1 to 4 and 8, the transmission unit 32 includes a transmission axle 321 and a coupling sleeve 322.

The transmission axle 321 extends along the longitudinal axis (L) through at least one of the first and second major gears 33, 33' to be coaxial with the first and second major gears 33, 33'. The transmission axle 321 is freely rotatable relative to the first and second major gears 33, 33'. In an embodiment shown in FIGS. 2 to 4 and 8, the transmission axle 321 may extend through the first major gear 33 to terminate at a left drive end 320, and each of the first and second major gears 33, 33' may have a center circular hole 330 and the transmission axle 321 may have a tetragonal cross-section so as to permit the transmission axle 321 to be freely rotatable relative to the first and second major gears 33, 33'.

Figure 4:
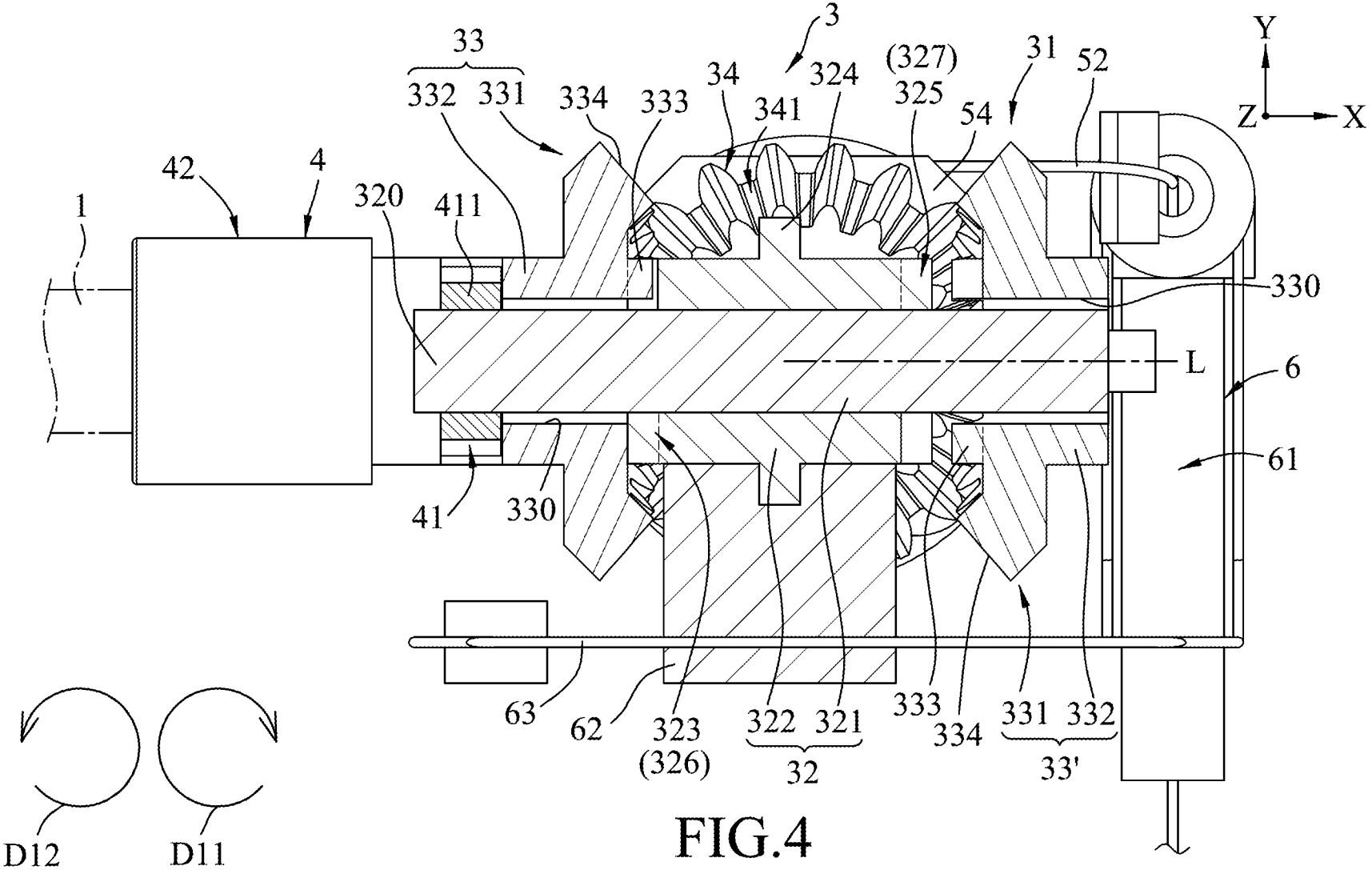
FIG. 4 is a cross-sectional view of FIG. 1 illustrating a coupling sleeve in a first coupling position.
Figure 5:
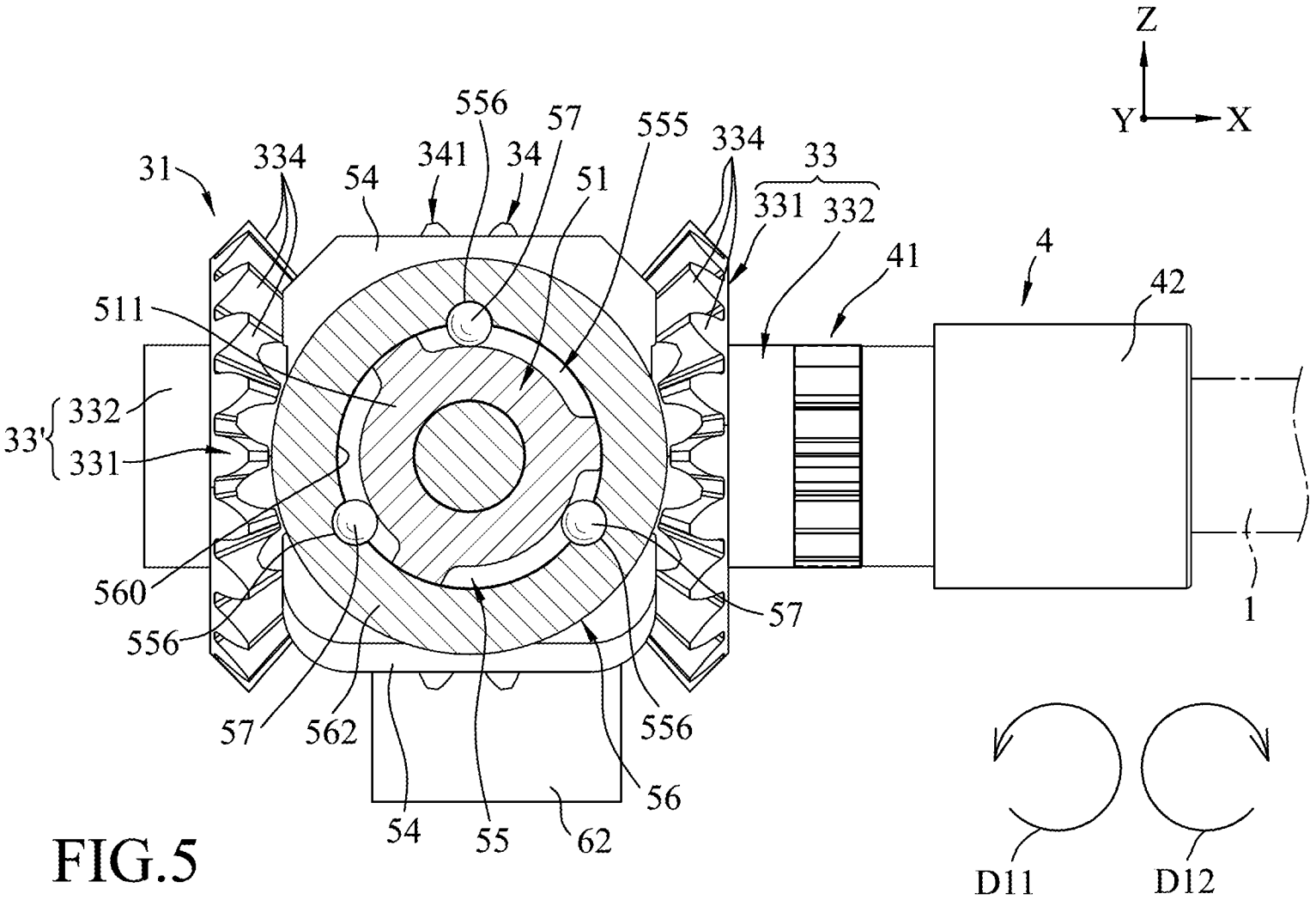
FIG. 5 is a cross-sectional view of FIG. 1 illustrating relationships among elements of a first unidirectional drive unit.
Figure 8:
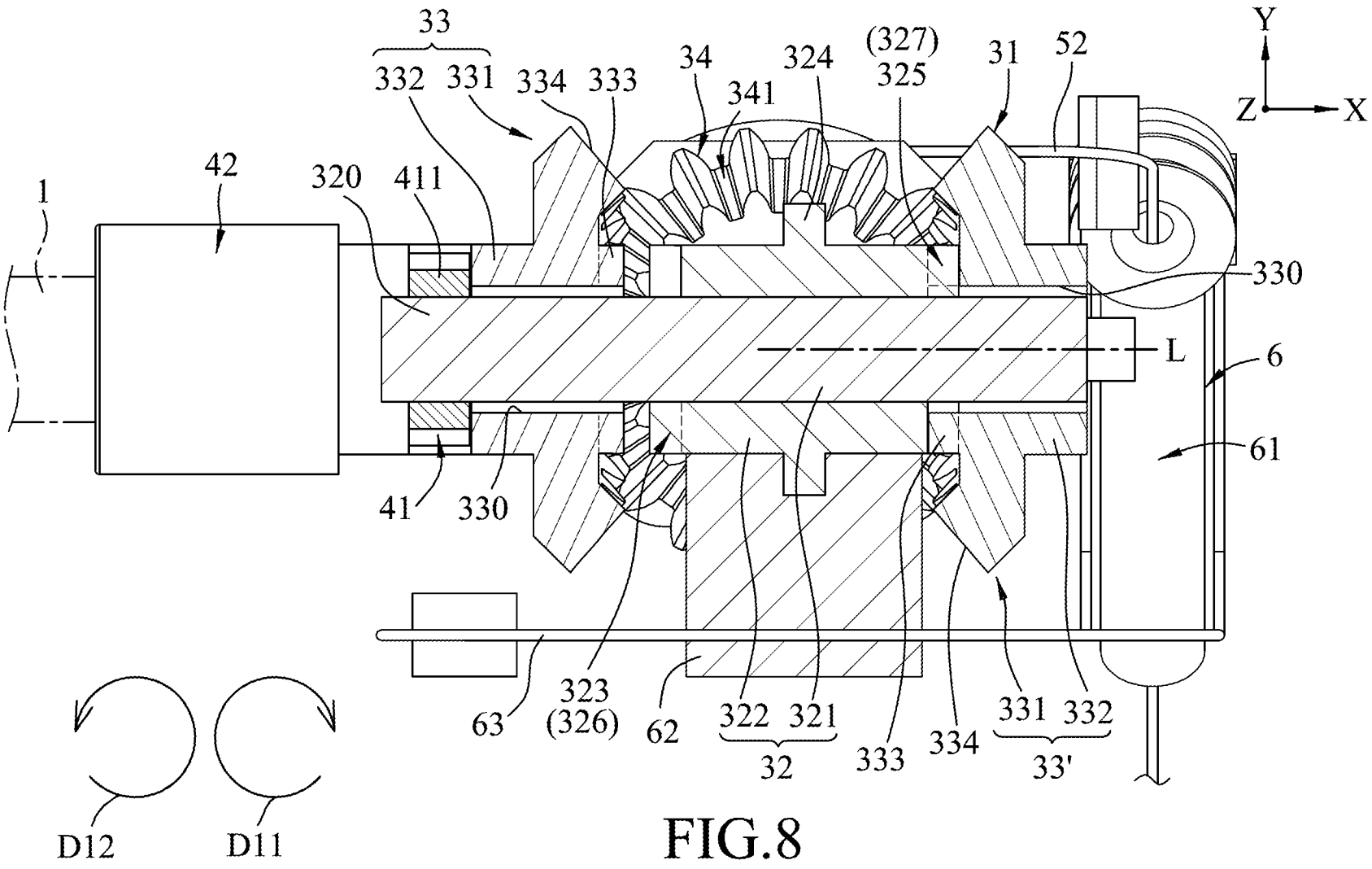
FIG. 8 is similar to FIG. 4 but illustrating the coupling sleeve in a second coupling position.
Figure 9:
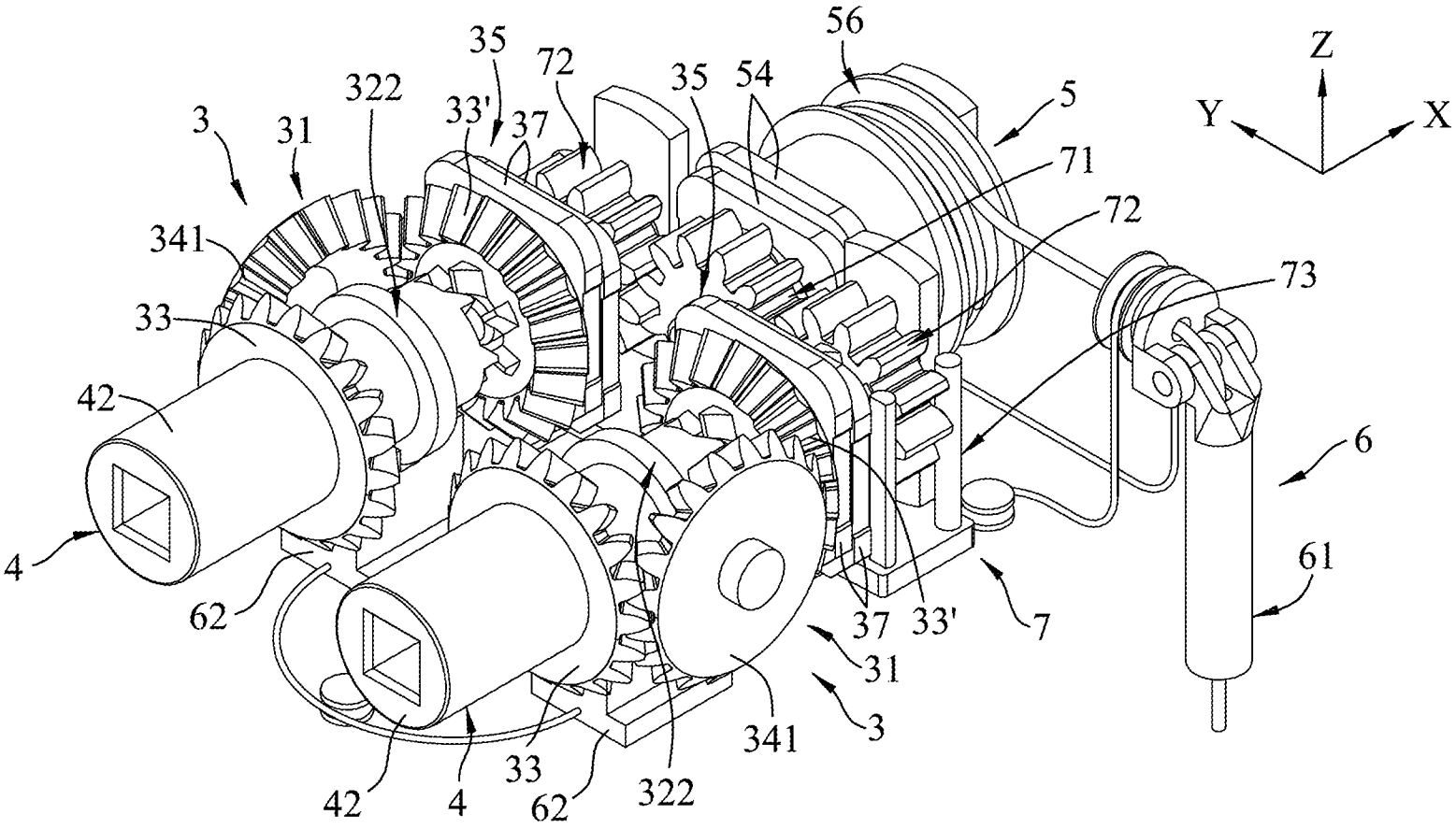
FIG. 9 is a perspective view of a controller assembly according to a second embodiment of the disclosure.

The coupling sleeve 322 is sleeved and retained on the transmission axle 321 to permit the transmission axle 321 to rotate therewith, and is located between the first and second major gears 33, 33'. The coupling sleeve 322 is actuatable to slide axially on the transmission axle 321 between a first coupling position and a second coupling position. In the first coupling position, as shown in FIG. 4, the coupling sleeve 322 is coupled to the first major gear 33 to permit the transmission unit 32 to rotate with the first major gear 33 in the first rotational direction (D21) as shown in FIGS. 1 to 3. In the second coupling position, as shown in FIG. 8, the coupling sleeve 322 is coupled to the second major gear 33' to permit the transmission unit 32 to rotate with the second major gear 33' in the second rotational direction (D22) as shown in FIGS. 1 to 3.

In an embodiment shown in FIGS. 1 to 4 and 8, the coupling sleeve 322 may have a first coupling end 323 and a second coupling end 325 opposite to the first coupling end 323 in the left-right direction (X).

The first coupling end 323 is formed with a plurality of first mating teeth 326 which are configured such that when the coupling sleeve 322 is in the first coupling position (FIG. 4), the first mating teeth 326 are in mesh with the inner mating teeth 333 of the first major gear 33 to permit the coupling sleeve 322 and the transmission axle 321 to rotate with the first major gear 33.

The second coupling end 325 is formed with a plurality of second mating teeth 327 which are configured such that when the coupling sleeve 322 is in the second coupling position (FIG. 8), the second mating teeth 327 are in mesh with the inner mating teeth 333 of the second major gear 33' to permit the coupling sleeve 322 and the transmission axle 321 to rotate with the second major gear 33'.

In an embodiment shown in FIGS. 1 to 3, the coupling sleeve 322 may be formed with a radial flange 324 between the first and second coupling ends 323, 325.

The drive mechanism 5 includes a pulling cord 52 and a spool unit 56. The spool unit 56 is coupled to the at least one transmission mechanism 3. The pulling cord 52 is coupled to and wound around the spool unit 56 such that when the pulling cord 52 is actuated to unwind from the spool unit 56, the gear unit 31 of the least one transmission mechanism 3 is driven to operate.

In an embodiment shown in FIGS. 2, 3, 5, and 6, the drive mechanism 5 may further include a drive mount 51, a first biasing spring 58, and a first unidirectional drive unit 55.

The drive mount 51 is coupled to drive operation of the gear unit 31, and includes a proximate portion 511 and a distal portion 512.

The first biasing spring 58 is mounted to the spool unit 56, and is configured to acquire a first biasing force when the pulling cord 52 is unwound from the spool unit 56.

The first unidirectional drive unit 55 is coupled between the spool unit 56 and the proximate portion 511 of the drive mount 51. When the pulling cord 52 is unwound from the spool unit 56 to drive rotation of the spool unit 56 in an unwinding direction (D11) which extends about a spool axis (S), the drive mount 51 is driven to rotate with the spool unit 56 in the unwinding direction (D11). When the pulling cord 52 is released to permit the spool unit 56 to be driven by the first biasing force to rotate in a winding direction (D12) for winding back the pulling cord 52 around the spool unit 56, the drive mount 51 is prevented from rotating with the spool unit 56.

In an embodiment shown in FIGS. 2, 3, 5, and 7, the controller assembly may further include a spool axle 561 extending along the spool axis (S). The spool unit 56 is retained on and rotatable relative to the spool axle 561 about the spool axis (S), and may include a spool tube 563 and a coupling tube 562. The pulling cord 52 is coupled to and wound around the spool tube 563. The coupling tube 562 has an inner peripheral surface 560 configured to confront the proximate portion 511 of the drive mount 51.

In addition, the first biasing spring 58 is coupled between the spool axle 561 and the spool tube 563 so as to acquire the first biasing force when the pulling cord 52 is unwound from the spool tube 563. In an embodiment shown in FIGS. 2 and 3, the first biasing spring 58 is a flat coil spring made of metal.

Figure 7:
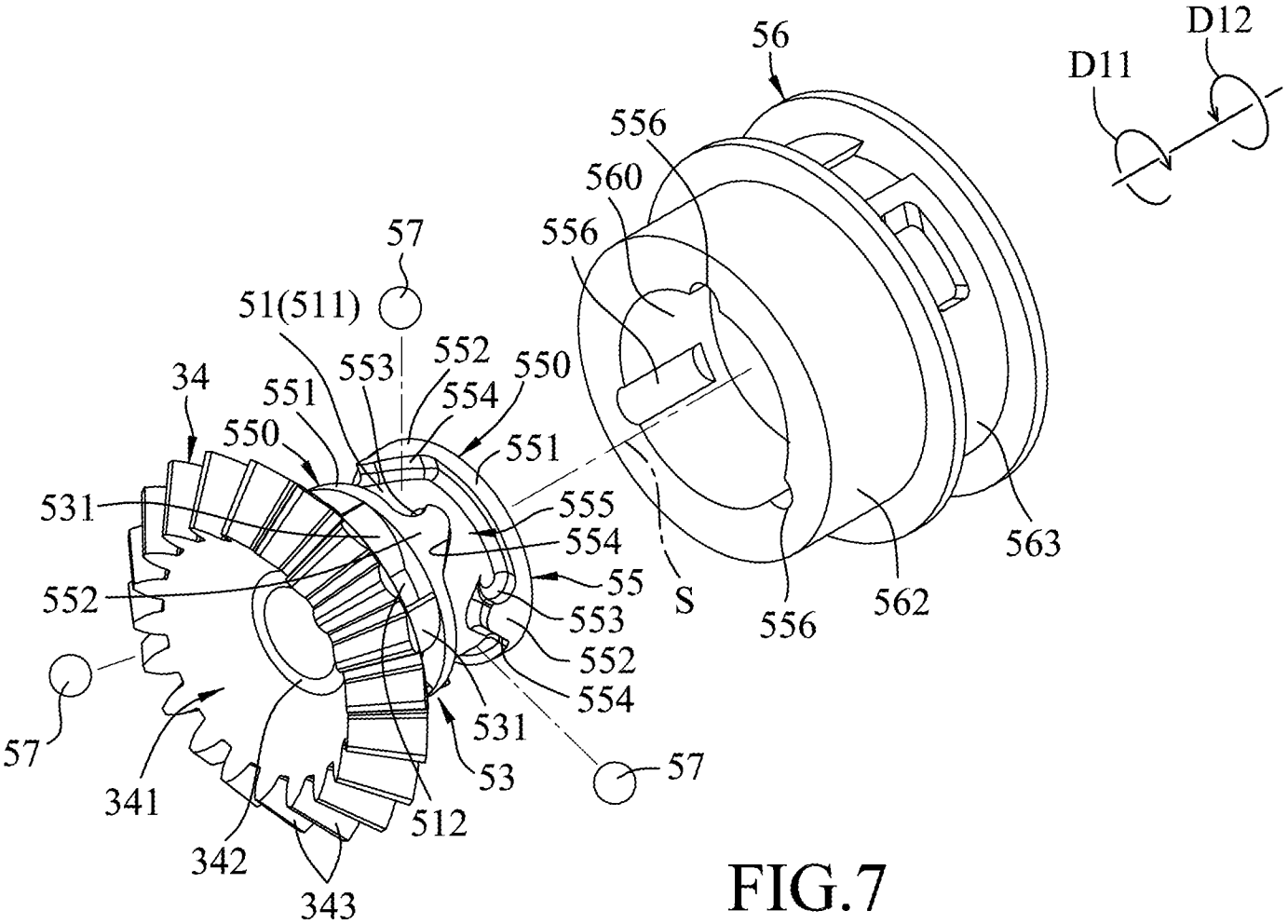
FIG. 7 is an exploded perspective view mainly illustrating the elements of the first unidirectional drive unit of the first embodiment.

In an embodiment shown in FIGS. 1 and 7, the first unidirectional drive unit 55 may include two first ratchet members 550, a plurality of first retaining grooves 556, and a plurality of first rolling balls 57.

The first ratchet members 550 are mounted on the proximate portion 511 of the drive mount 51, and are spaced apart from each other in a direction of the spool axis (S) to define therebetween a first surrounding groove 555 extending about the spool axis (S). Each of the first ratchet members 550 includes a first flange wall 551 and a plurality of first teeth 552. The first flange wall 551 extends radially and outwardly from the proximate portion 511. The first teeth 552 extend from the first flange wall 551 to border the first surrounding groove 555 together with the first flange wall 551, and are angularly displaced from each other about the spool axis (S). Each of the first teeth 552 has a first abutment edge 553 and a first guiding edge 554 opposite to the first abutment edge 553.

The first retaining grooves 556 are formed in the inner peripheral surface 560 of the coupling tube 562, and are angularly displaced from each other about the spool axis (S). Each of the first retaining grooves 556 extends in the direction of the spool axis (S).

The first rolling balls 57 are slidably and respectively retained in the first retaining grooves 556, and are rollable in the first surrounding groove 555. When the spool unit 56 is driven to rotate in the unwinding direction (D11), each of the first rolling balls 57 is brought into abutting engagement with a corresponding one of the first abutment edges 553 of the first teeth 552 of the first ratchet members 550 to thereby permit the drive mount 51 to rotate with the spool unit 56. When the spool unit 56 is driven to rotate in the winding direction (D12), each of the first rolling balls 57 is guided by the first guiding edges 554 of the first teeth 552 of the first ratchet members 550 to roll along the first surrounding groove 555 to thereby prevent the drive mount 51 from rotating with the spool unit 56.

Figure 6:
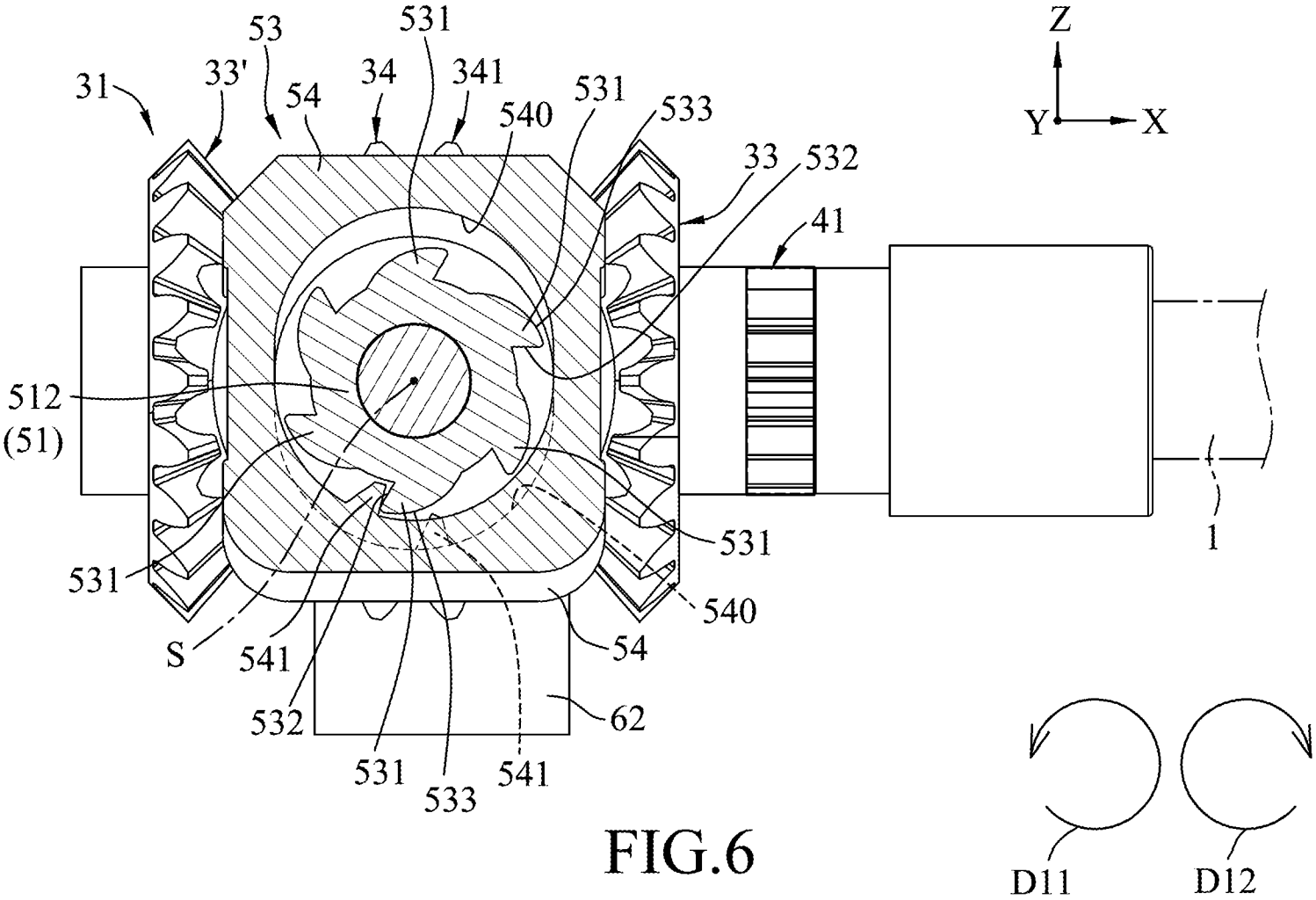
FIG. 6 is a cross-sectional view of FIG. 1 illustrating relationships among elements of a second unidirectional drive unit.

In an embodiment shown in FIGS. 2, 3, and 6, the drive mechanism 5 may further include a second unidirectional drive unit 53 coupled to the distal portion 512 of the drive mount 51 such that when the spool unit 56 rotates in the unwinding direction (D11), the gear unit 31 is driven by the drive mount 51 to operate, and such that when the spool unit 56 rotates in the winding direction (D12), the gear unit 31 is prevented from being driven by the drive mount 51 to operate.

In an embodiment shown in FIGS. 2, 3, and 6, the second unidirectional drive unit 53 may include a plurality of ratchet teeth 531 and at least one restriction member 54.

The ratchet teeth 531 are formed on the distal portion 512 of the drive mount 51, and are angularly displaced from each other about the spool axis (S). Each of the ratchet teeth 531 has an engaging edge 532 and a sweeping edge 533 opposite to the engaging edge 532.

The restriction member 54 is coupled to be only movable in an upright direction (Z), and is formed with a through bore 540 configured to receive the distal portion 512 of the drive mount 51 therein. The restriction member 54 has a pawl 541 disposed in the through hole 540. When the spool unit 56 rotates in the unwinding direction (D11), the sweeping edges 533 of the ratchet teeth 531 sweep pass the pawl 541 to permit the drive mount 51 to rotate with the spool unit 56, thereby allowing the gear unit 31 to be driven by the drive mount 51 to operate. When the spool unit 56 rotates in the winding direction (D12), the engaging edge 532 of a corresponding one of the ratchet teeth 531 is engaged by the pawl 541 to prevent the drive mount 51 from rotating with the spool unit 56, thereby preventing the gear unit 31 from being driven by the drive mount 51 to operate. In an embodiment shown in FIGS. 1 to 3 and 6, the second unidirectional drive unit 53 may include two of the restriction members 54 each of which is in a plate form.

In an embodiment shown in FIGS. 2 and 3, the longitudinal axis (L) is transverse to the spool axis (S), and the central portion 342 of the auxiliary bevel gear 341 extends from the distal portion 512 of the drive mount 51 so as to permit the auxiliary bevel gear 341 to be driven by the drive mount 51 to rotate about the spool axis (S).

In an embodiment shown in FIGS. 2 and 3, the spool axis (S) extends in a front-rear direction (Y).

In an embodiment shown in FIGS. 1 to 4 and 8, the controller assembly may further include an output mechanism 4 which includes an output gear set 41 and an output sleeve 42. The output sleeve 42 is sleeved on an end of the turning axle 1 to permit the turning axle 1 to turn with the output sleeve 42. The output gear set 41 is coupled between the left drive end 320 of the transmission axle 321 and the output sleeve 42 so as to permit the output sleeve 42 to be driven by the transmission axle 321 to rotate through the output gear set 41. The output gear set 41 may include a first gear 411 and a second gear 412. The first gear 411 is mounted to the left drive end 320 so as to rotate with the transmission axle 321 about the longitudinal axis (L). The second gear 412 is in mesh with the first gear 411 so as to be driven by the first gear 411 to rotate, and is mounted to the output sleeve 42 so as to permit the output sleeve 42 to be driven by the second gear 412 to rotate.

In an embodiment shown in FIGS. 1 to 4 and 8, the controller assembly may further include a control mechanism 6 which includes a controller 61, a coupling mount 62, and a first actuating member 63.

The coupling mount 62 is coupled to permit the coupling sleeve 322 to move therewith. In an embodiment shown in FIGS. 2 and 3, the coupling mount 62 is formed with a retaining recess 621 configured to retain the radial flange 324 of the coupling sleeve 322 therein.

The first actuating member 63 is connected between the controller 61 and the coupling mount 62 such that in response to actuation of the controller 61, the coupling sleeve 322 is driven by the coupling mount 62 to move between the first and second coupling positions. In an embodiment shown in FIGS. 4 and 8, the first actuating member 63 may be a rigid metal cable.

In an embodiment shown in FIGS. 2 and 3, the transmission mechanism 3, the output mechanism 4, the drive mechanism 5, and the control mechanism 6 may be supported, positioned, and accommodated in a housing mechanism 2 so as to functionalize those mechanisms 3, 4, 5, 6. Because how the housing mechanism 2 is configured to support, position, and accommodate the mechanisms 3, 4, 5, 6 is well-known in the art, the detail thereof is omitted for the sake of brevity.

In the case that the coupling sleeve 322 is actuated by the control mechanism 6 to the first coupling position and is coupled to the first major gear 33 (FIG. 4), the transmission axle 321 is driven to rotate with the first major gear 33 in the first rotational direction (D21) in response to pulling of the pulling cord 52. Meanwhile, the output sleeve 42 is driven by the transmission axle 321 to wind down the window blind (not shown) on the turning axle 1. In response to release of the pulling cord 52, the pulling cord 52 will wind back on the spool tube 563 whilst the gear unit 31 is prevented from being driven to operate. Therefore, a user may repeat the pulling and releasing of the pulling cord 52 to wind down the window blind to a desired position.

Similarly, in the case that the coupling sleeve 322 is actuated by the control mechanism 6 to the second coupling position and is coupled to the second major gear 33' (FIG. 8), the transmission axle 321 is driven to rotate with the second major gear 33' in the second rotational direction (D22) in response to pulling of the pulling cord 52. Meanwhile, the output sleeve 42 is driven by the transmission axle 321 to wind up the window blind (not shown) on the turning axle 1. In response to release of the pulling cord 52, the pulling cord 52 will wind back on the spool tube 563 whilst the gear unit 31 is prevented from being driven to operate. Therefore, a user may repeat the pulling and releasing of the pulling cord 52 to wind up the window blind to a desired position.

Because the pulling cord 52 is normally wound around the spool tube 563, it may have a relatively small length and is less likely to be accessed by a child. Therefore, the pulling cord 52 may be prevented from being wound around the neck of the child.

FIGS. 9 to 12 illustrate a controller assembly according to a second embodiment of the disclosure. The second embodiment is similar to the first embodiment, except that in the second embodiment, each of the longitudinal axis (L) and the spool axis (S) extends in the left-right direction (X), and the tubular portion 332 of the second major gear 33', rather than the central portion 342 of the auxiliary bevel gear 341, is coupled to be driven by the drive mount 51 when the spool unit 56 is driven to rotate in the unwinding direction (D11).

In an embodiment shown in FIGS. 9 to 12, the controller assembly may include two of the transmission mechanisms 3 that are juxtaposed in the front-rear direction (Y).

In an embodiment shown in FIGS. 9 to 12, each of the transmission mechanisms 3 may further include a third unidirectional drive unit 35 coupled to permit the second major gear 33' to rotate only in the second rotational direction (D22).

The third unidirectional drive unit 35 may have a configuration similar to the second unidirectional drive unit 53 shown in FIGS. 3 and 6, and may include a plurality of ratchet teeth 36 and at least one restriction member 37. The ratchet teeth 36 are formed on the tubular portion 332 of the second major gear 33' and are angularly displaced from each other about the longitudinal axis (L). Each of the ratchet teeth 36 has an engaging edge (not shown) and a sweeping edge (not shown) similar to the engaging edge 532 and the sweeping edge 533 shown in FIG. 6.

The restriction member 37 is coupled to be only movable in the upright direction (Z), and is formed with a through bore 370 configured to receive the tubular portion 332 of the second major gear 33' therein. The restriction member 37 has a pawl 371 disposed in the through hole 370 and has a configuration similar to the restriction member 54 shown in FIGS. 3 and 6. Thereby, the second major gear 33' can rotate only in the second rotational direction (D22).

In an embodiment shown in FIGS. 9 to 12, the third unidirectional drive unit 35 may include two of the restriction members 37 each of which is in a plate form.

Figure 11:
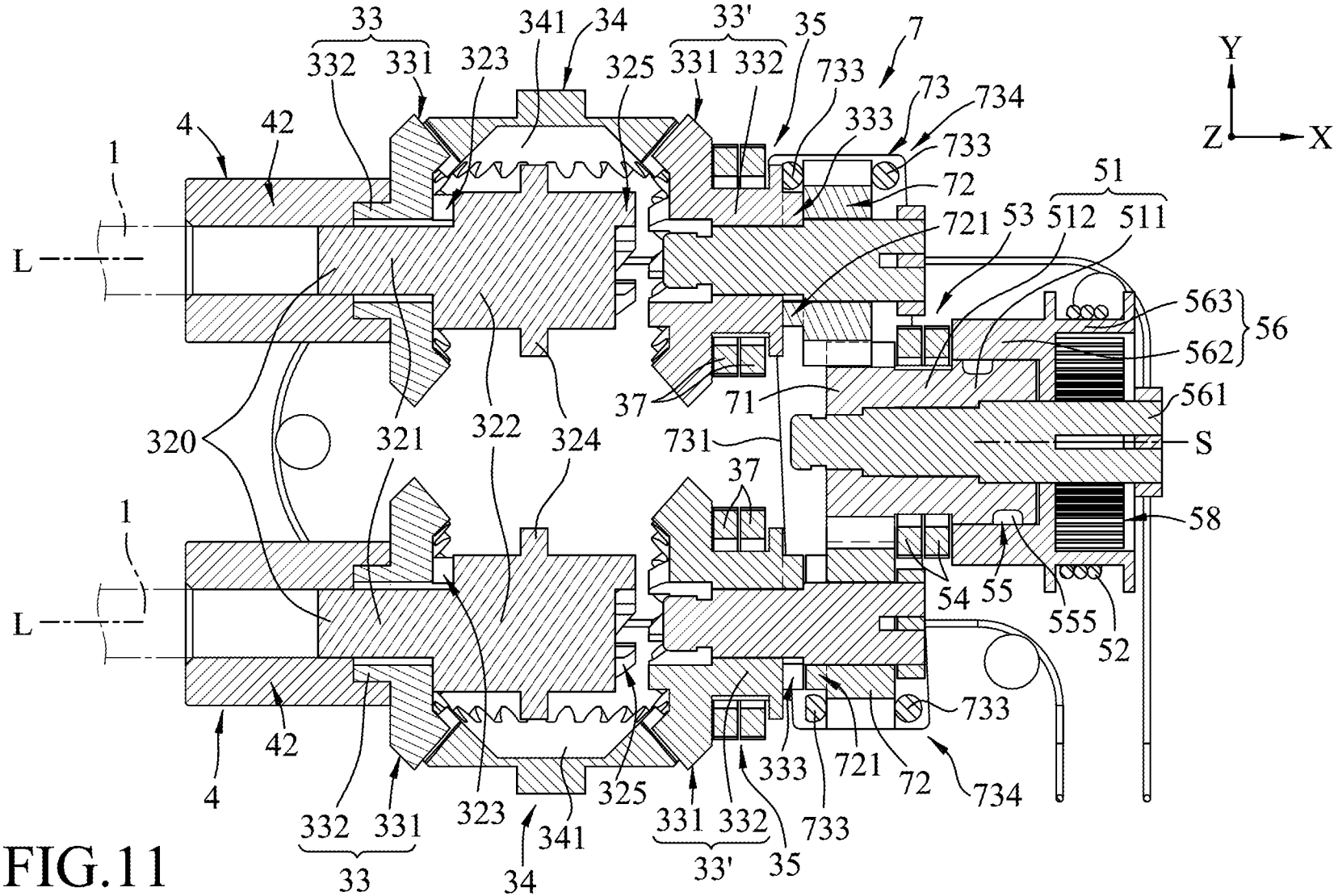
FIG. 11 is a cross-sectional view of FIG. 9, illustrating a first switch member in a first actuated position.
Figure 12:
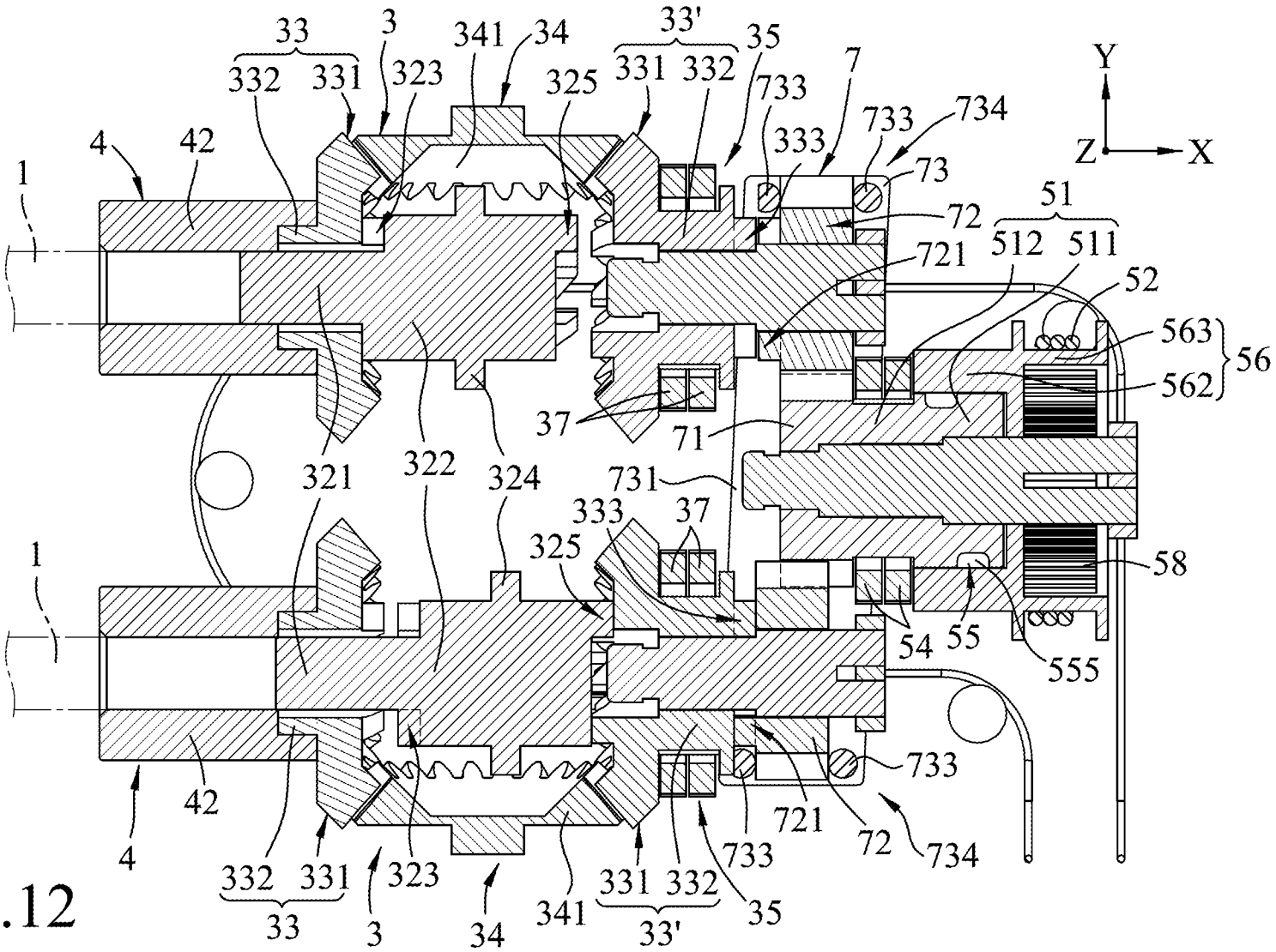
FIG. 12 is similar to FIG. 11 but illustrating the first switch member in a second actuated position.

In an embodiment shown in FIGS. 11 and 12, the transmission axle 321 and the coupling sleeve 322 are integrally formed. In this case, the transmission axle 321 is driven to slide axially with the coupling sleeve 322.

In an embodiment shown in FIGS. 9 to 12, the controller assembly may further include a first switch mechanism 7 which is configured to permit the distal portion 512 of the drive mount 51 to selectively couple to the second major gear 33' of a selected one of the transmission mechanisms 3 to thereby drive operation of the gear unit 31 of the selected one of the transmission mechanisms 3.

In an embodiment shown in FIGS. 9 to 12, the first switch mechanism 7 may include a first central gear 71, two first side gears 72, and a first switch member 73.

The first central gear 71 is coupled to the distal portion 512 of the drive mount 51 such that when the spool unit 56 rotates in the unwinding direction (D11), the first central gear 71 is driven to rotate with the drive mount 51.

The first side gears 72 are disposed respectively at front and rear sides of the first central gear 71. Each of the first side gears 72 has a plurality of first gear teeth 720 and a leftward coupling portion 721. The first gear teeth 720 are configured to be in mesh with the first central gear 71. The leftward coupling portion 721 is configured to be detachably coupled to the tubular portion 332 of the second major gear 33' of a respective one of the transmission mechanisms 3 so as to drive rotation of the second major gear 33' of the respective transmission mechanism 3.

The first switch member 73 has two first retaining portions 734 which are configured to respectively retain the first side gears 72. The first switch member 73 is turnable about a first turning axis (T1) which extends in the upright direction (Z) so as to switch between a first actuated position and a second actuated position. In the first actuated position, as shown in FIG. 11, the leftward coupling portion 721 of a front one of the first side gears 72 is coupled to the tubular portion 332 of the second major gear 33' of a front one of the transmission mechanisms 3 whilst the leftward coupling portion 721 of a rear one of the first side gears 72 is detached from the tubular portion 332 of the second major gear 33' of a rear one of the transmission mechanisms 3. In the second actuated position, as shown in FIG. 12, the leftward coupling portion 721 of the rear one of the first side gears 72 is coupled to the tubular portion 332 of the second major gear 33' of the rear one of the transmission mechanisms 3 whilst the leftward coupling portion 721 of the front one of the first side gears 72 is detached from the tubular portion 332 of the second major gear 33' of the front one of the transmission mechanisms 3.

In an embodiment shown in FIGS. 11 and 12, the tubular portion 332 of the second major gear 33' of each of the transmission mechanisms 3 may have a rightward coupling region 333 for coupling with the leftward coupling portion 721 of a respective one of the first side gears 72.

Figure 10:
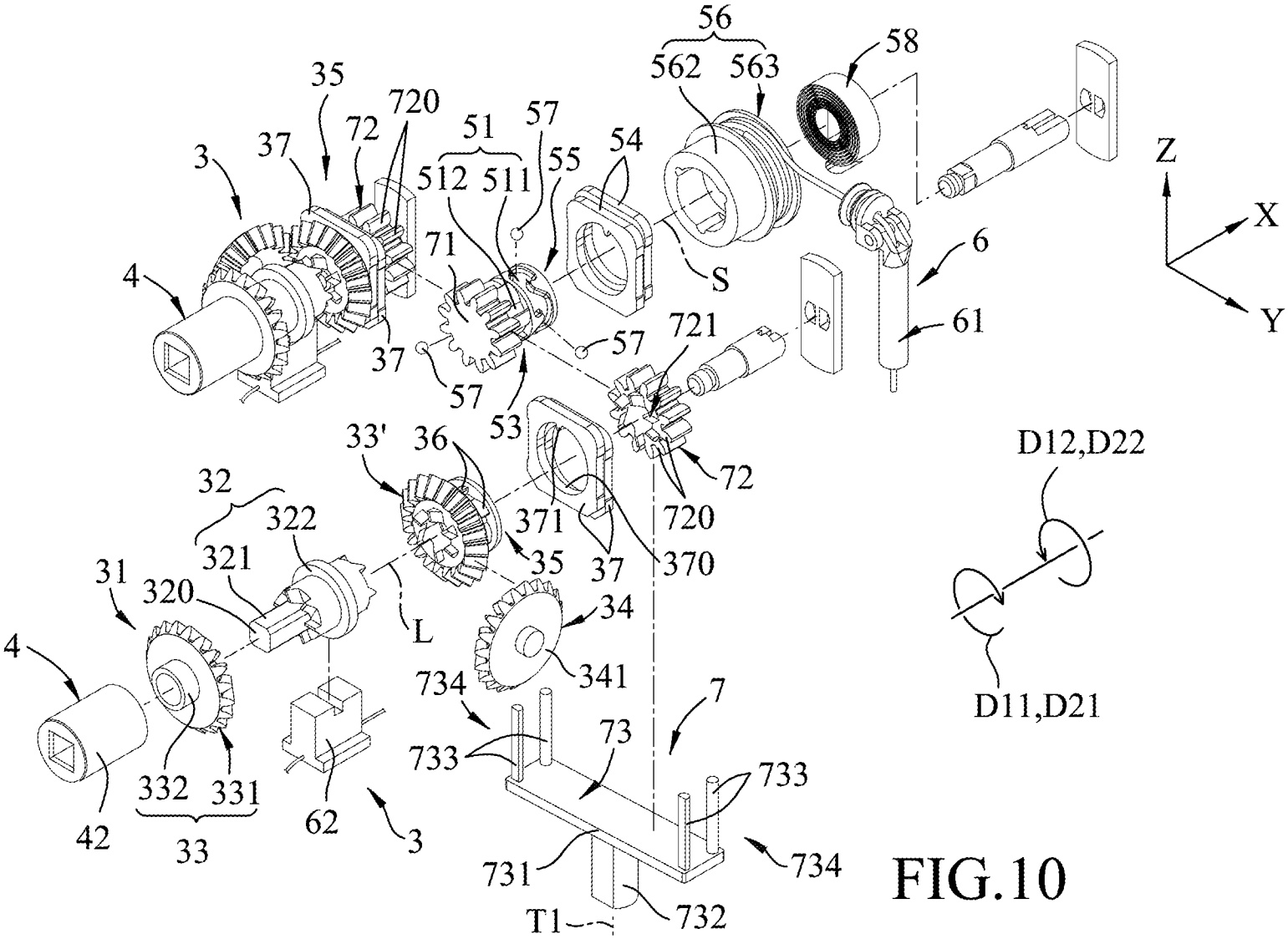
FIG. 10 is an exploded perspective view of the second embodiment in which some elements are fragmentary shown.

In an embodiment shown in FIGS. 10 to 12, the first switch member 73 may include an elongated plate 731, a turnable post 732, and four retaining pins 733. The elongated plate 731 extends in the front-rear direction (Y). The turnable post 732 extends downwardly from a bottom surface of the elongated plate 731 along the first turning axis (T1), and is coupled to a housing mechanism (not shown, but having a similar function of the housing mechanism 2 of the first embodiment) so as to permit the first switch member 73 to turn about the first turning axis (T1). The retaining pins 733 are respectively mounted on four corners of an upper surface of the elongated plate 731. Two rear ones of the retaining pins 733 serve as the rear one of the first retaining portions 734, and two front ones of the retaining pins 733 serve as the front one of the first retaining portions 734.

In an embodiment shown in FIGS. 9 to 12, the controller assembly may include two of the output mechanisms 4 which are spaced apart from each other in the front-rear direction (Y) for respectively driving two of the turning axles 1. Two different window blinds (not shown) may be driven respectively by the turning axles 1 to wind up and down. Each of the output mechanisms 4 may include only the output sleeve 42 which has two ends, one of which is coupled to the tubular portion 332 of the first major gear 33 of a respective one of the transmission mechanisms 3, and the other of which is sleeved on a respective one of the turning axles 1.

By switching the first switch member 73 to the first actuated position, a front one of the turning axles 1 is driven to wind up or down a front one of the window blinds. By switching the first switch member 73 to the second actuated position, a rear one of the turning axles 1 is driven to wind up or down a rear one of the window blinds.

Figure 14:
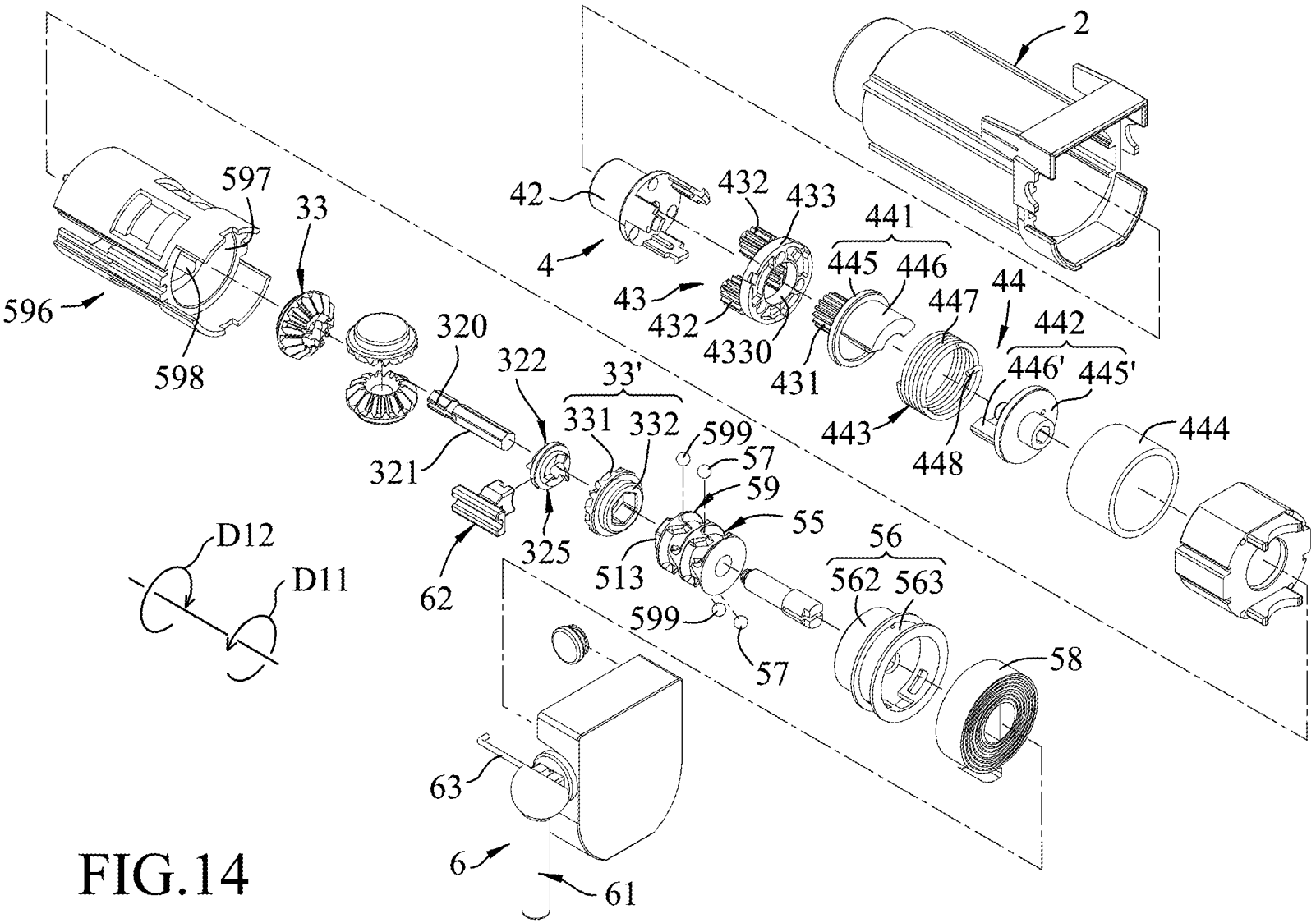
FIG. 14 is similar to FIG. 13 but illustrating at a different angle of view.
Figure 15:
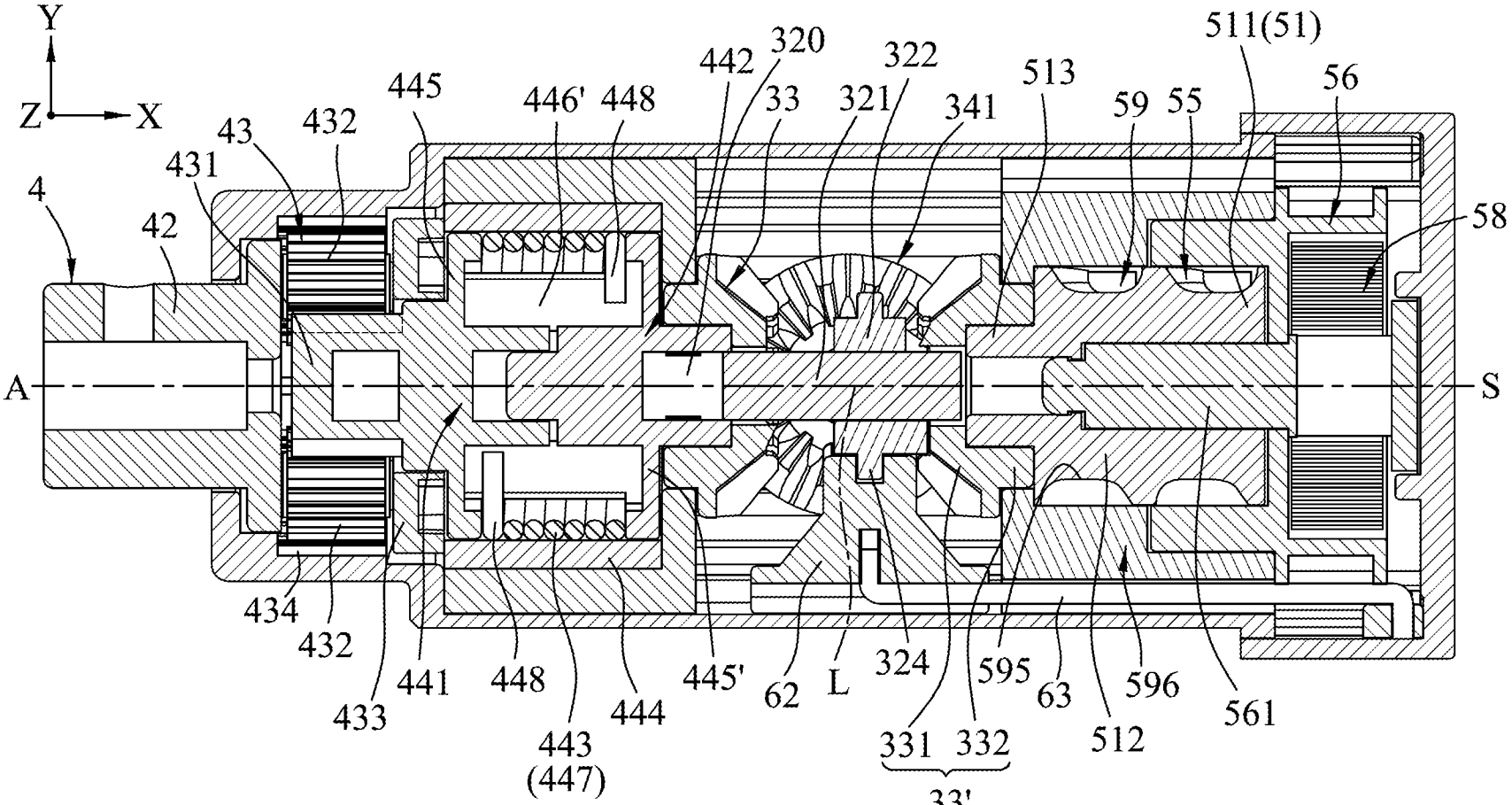
FIG. 15 is a cross-sectional view of the third embodiment taken in a left-right direction, in which the pulling cord is omitted.
Figure 16:
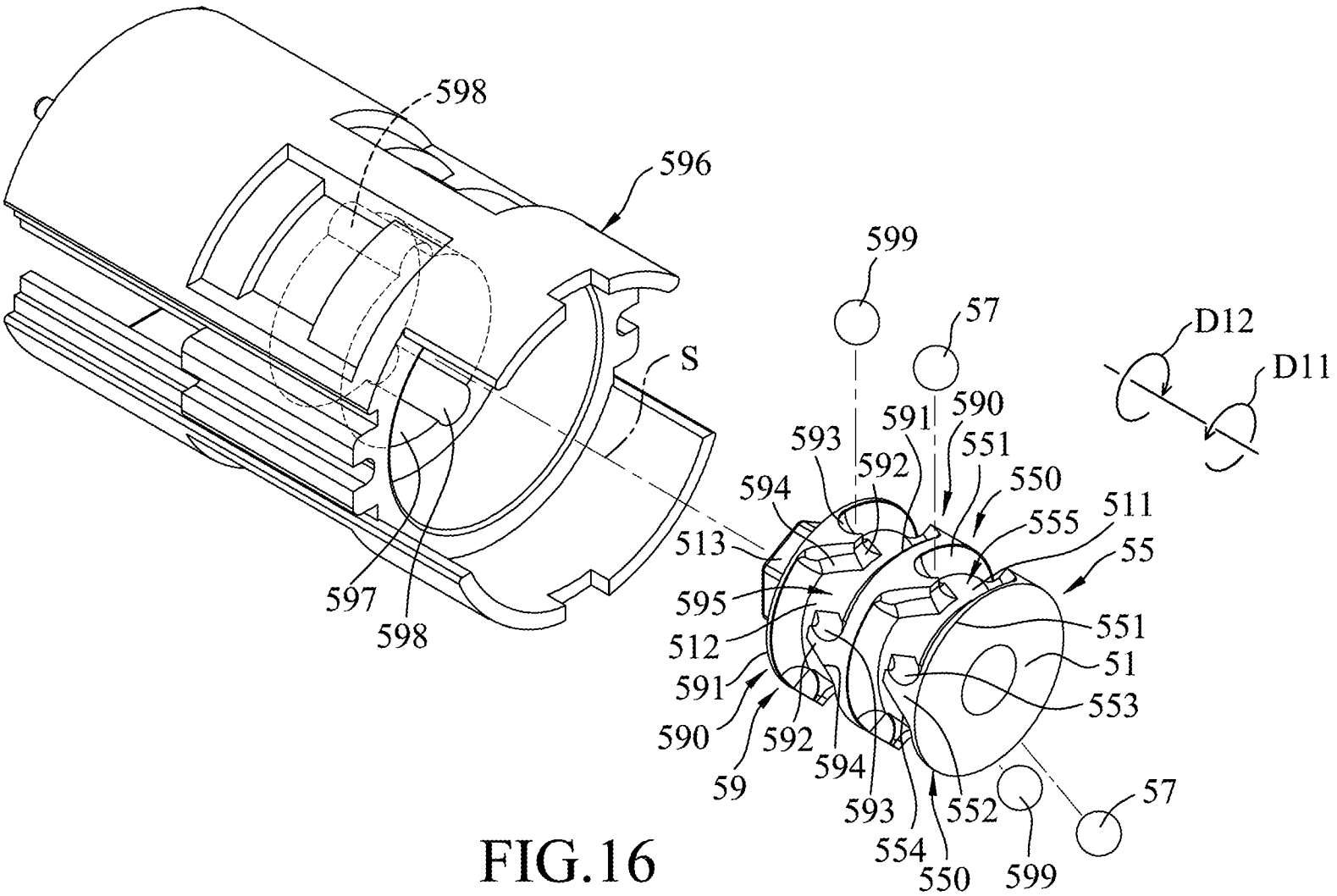
FIG. 16 is an exploded perspective view mainly illustrating a second unidirectional drive unit of the third embodiment.
Figure 17:
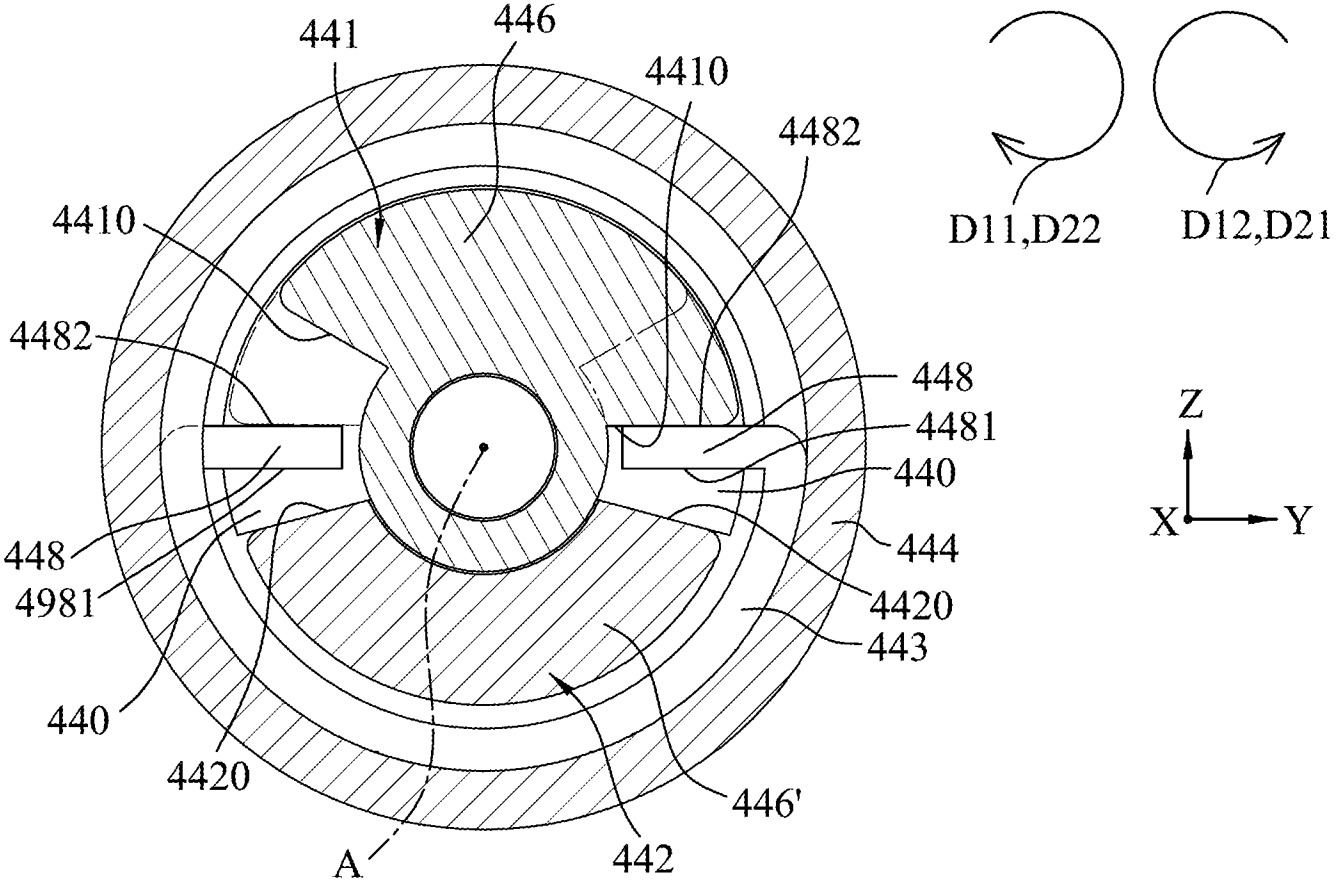
FIG. 17 is a cross-sectional view of the third embodiment taken in a front-rear direction.

FIGS. 13 to 17 illustrate a controller assembly according to a third embodiment of the disclosure. The third embodiment is similar to the first embodiment, except that in the third embodiment, a second unidirectional drive unit 59 is provided for replacement of the second unidirectional drive unit 53. As shown in FIG. 16, the second unidirectional drive unit 59 may include two second ratchet members 590, a tubular case 596, and a plurality of second rolling balls 599.

The second ratchet members 590 are mounted on the distal portion 512 of the drive mount 51, and are spaced apart from each other in the direction of the spool axis (S) to define therebetween a second surrounding groove 595 extending about the spool axis (S). Each of the second ratchet members 590 includes a second flange wall 591 and a plurality of second teeth 592. The second flange wall 591 extends radially and outwardly from the distal portion 512. The second teeth 592 extend from the second flange wall 591 to border the second surrounding groove 595 together with the second flange wall 591, and are angularly displaced from each other about the spool axis (S). Each of the second teeth 592 has a second abutment edge 593 and a second guiding edge 594 opposite to the second abutment edge 593.

The tubular case 596 is immovably retained by the housing mechanism 2 and is mounted around the distal portion 512 of the drive mount 51. The tubular case 596 has an inner tubular surface 597 formed with a plurality of second retaining grooves 598 which are angularly displaced from each other about the spool axis (S). Each of the second retaining grooves 598 extends in the direction of the spool axis (S).

The second rolling balls 599 are slidably and respectively retained in the second retaining grooves 598, and are rollable in the second surrounding groove 595. When the spool unit 56 is driven to rotate in the unwinding direction (D11), each of the second rolling balls 599 is brought into abutting engagement with a corresponding one of the second abutment edges 593 of the second teeth 592 of the second ratchet members 590 to permit the drive mount 51 to rotate with the spool unit 56, thereby allowing the gear unit 31 to be driven by the drive mount 51 to operate. When the spool unit 56 is driven to rotate in the winding direction (D12), each of the second rolling balls 599 is guided by the second guiding edges 594 of the second teeth 592 of the second ratchet members 590 to roll along the second surrounding groove 595 to prevent the drive mount 51 from rotating with the spool unit 56, thereby preventing the gear unit 31 from being driven by the drive mount 51 to operate.

Figure 13:
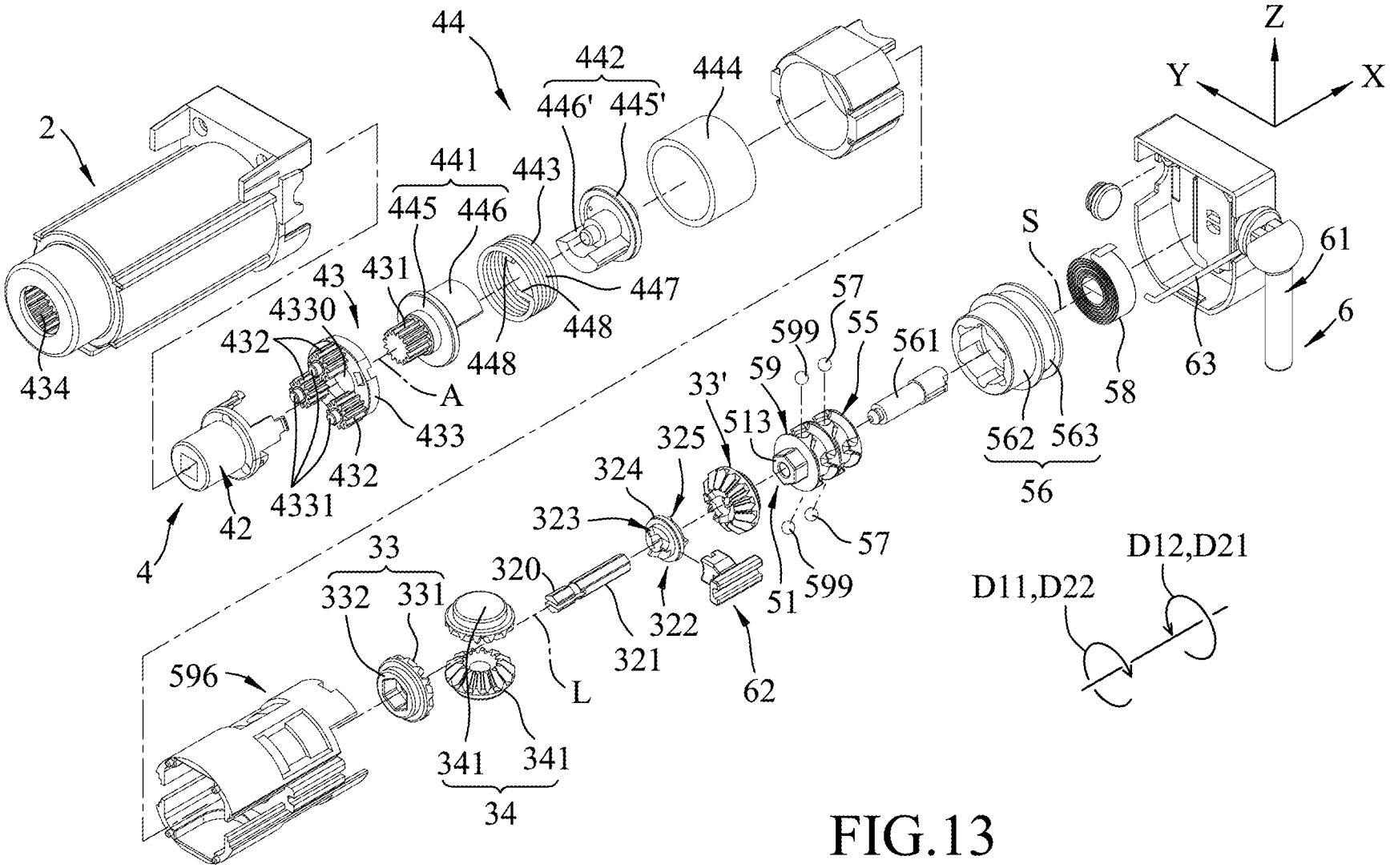
FIG. 13 is an exploded perspective view of a controller assembly according to a third embodiment of the disclosure, in which a pulling cord is omitted.

In an embodiment shown in FIGS. 13 to 15, each of the longitudinal axis (L) and the spool axis (S) extends in the left-right direction (X), and the drive mount 51 has a left end 513 which is disposed leftward of the distal portion 512, and which is in splined engagement with the tubular portion 332 of the second major gear 33' to permit the unwinding direction (D11) to be the same as the second rotational direction (D22), to thereby allow the second major gear 33' to be driven by the drive mount 51 to rotate only in the second rotational direction (D22).

In an embodiment shown in FIGS. 13 to 15, the auxiliary gear set 34 may include two of the auxiliary bevel gears 341 each of which is in mesh simultaneously with the outer bevel teeth 334 of the first and second major gears 33, 33'. The auxiliary bevel gears 341 are disposed opposite to each other in the upright direction (Z).

In an embodiment shown in FIGS. 13 to 15 and 17, the output mechanism 4 does not include the output gear set 41 of the first embodiment, and may further include a one-way actuator 44 which defines an actuating axis (A) in the left-right direction (X), and which includes a left actuating member 441, a right actuating member 442, a coil spring 443, and a sleeve member 444.

The left actuating member 441 has a left end mount 445, and a first curved piece 446 which extends from a right surface of the left end mount 445, and which extends about the actuating axis (A) to terminate at two first actuating edges 4410.

The right actuating member 442 has a right end mount 445' and a second curved piece 446'. The right end mount 445' is coupled to be driven by the left drive end 320 to rotate about the actuating axis (A), and is spaced apart from the left end mount 445 in the left-right direction (X). The second curved piece 446' extends from a left surface of the right end mount 445', and extends about the actuating axis (A) to terminate at two second actuating edges 4420. Each of the second abutting edges 4420 is angularly displaced from a respective one of the first abutting edges 4410 about the actuating axis (A) to define a gap 440 therebetween (see FIG. 17).

The sleeve member 444 is configured to accommodate the first and second curved pieces 446, 446' therein.

The coil spring 443 has a spring body 447 and two spring ends 448. The spring body 447 is configured to surround the first and second curved pieces 446, 446', and is compressedly disposed inside the sleeve member 444. Each of the spring ends 448 has a wind-up edge 4481 and a wind-down edge 4482, and is disposed in the gap 440 between one of second abutting edges 4420 and a corresponding one of the first abutting edges 4410. The wind-up edges 4481 of the spring ends 448 are disposed to respectively confront the second actuating edges 4420 of the second curved piece 446'. The wind-down edges 4482 of the spring ends 448 are disposed to respectively confront the first actuating edges 4410 of the first curved piece 446.

When the right actuating member 442 is driven by the left drive end 320 to rotate, one of the second actuating edges 4420 is brought into abutment with a corresponding one of the wind-up edges 4481 to permit the spring body 447 to be tightened to have an outer dimension less than an inner dimension of the sleeve member 444, thereby allowing the first curved piece 446 together with the left end mount 445 to be driven by the second curved piece 446' to rotate about the actuating axis (A). It should be noted that when the right actuating member 442 is driven to rotate with the first major gear 33, one of the second actuating edges 4420 is brought into abutment with one of the wind-up edges 4481 so as to tighten the spring body 447, thereby allowing winding down of the window blind. When the right actuating member 442 is driven to rotate with the second major gear 33', the other one of the second actuating edges 4420 is brought into abutment with the other one of the wind-up edges 4481 so as to tighten the spring body 447, thereby allowing winding up of the window blind.

When the left actuating member 441 is forced to drive rotation of the right actuating member 442, one of the first actuating edges 4410 is brought into abutment with a corresponding one of the wind-down edges 4482 to permit the spring body 447 to be expanded into frictional contact with an inner peripheral surface of the sleeve member 444, thereby preventing the right actuating member 442 from being driven by the left actuating member 441 to rotate.

With the provision of the one-way actuator 44, winding up and down of the window blind can be actuated only by pulling the pulling cord 52 (shown in FIG. 1).

In an embodiment shown in FIGS. 13 to 15, the longitudinal axis (L) is in line with the actuating axis (A), and the left drive end 320 of the transmission axle 321 is in splined engagement with the right end mount 445' of the right actuating member 442 so as to permit the right actuating member 442 to be driven by the transmission axle 321 to rotate.

In an embodiment shown in FIGS. 13 to 15, the output mechanism 4 may further include a speed reducer 43 which includes a sun gear 431, a plurality of planet gears 432, a carrier web 433, and a ring gear 434.

The sun gear 431 is mounted on a left surface of the left end mount 445 to rotate with the left actuating member 441 about the actuating axis (A).

The carrier web 433 is disposed leftward of the left end mount 445, and has a central hole 4330 configured for extension of the sun gear 431 therethrough.

The ring gear 434 is immovably retained around the sun gear 431. As shown in FIG. 13, the ring gear 434 may be retained by the housing mechanism 2 to surround the sun gear 431.

The planet gears 432 are rotatably mounted on the carrier web 433, and are angularly displaced from each other about the actuating axis (A). Each of the planet gears 432 is configured to mesh with both of the sun gear 431 and the ring gear 434 such that when the sun gear 431 is driven to rotate with the left actuating member 441, the planet gears 432 are driven to rotate about the sun gear 431, thereby driving rotation of the carrier web 433 at a slower speed than the left actuating member 441.

The output sleeve 42 is coupled to rotate with the carrier web 433.

In an embodiment shown in FIGS. 13 and 14, the carrier web 433 has a plurality of carrier pins 4331, and each of the planet gears 432 has a through hole configured to permit the planet gears 432 to be rotatably and respectively sleeved on carrier pins 4331 to permit the planet gears 432 to be rotatably mounted on the carrier web 433.

Figure 18:
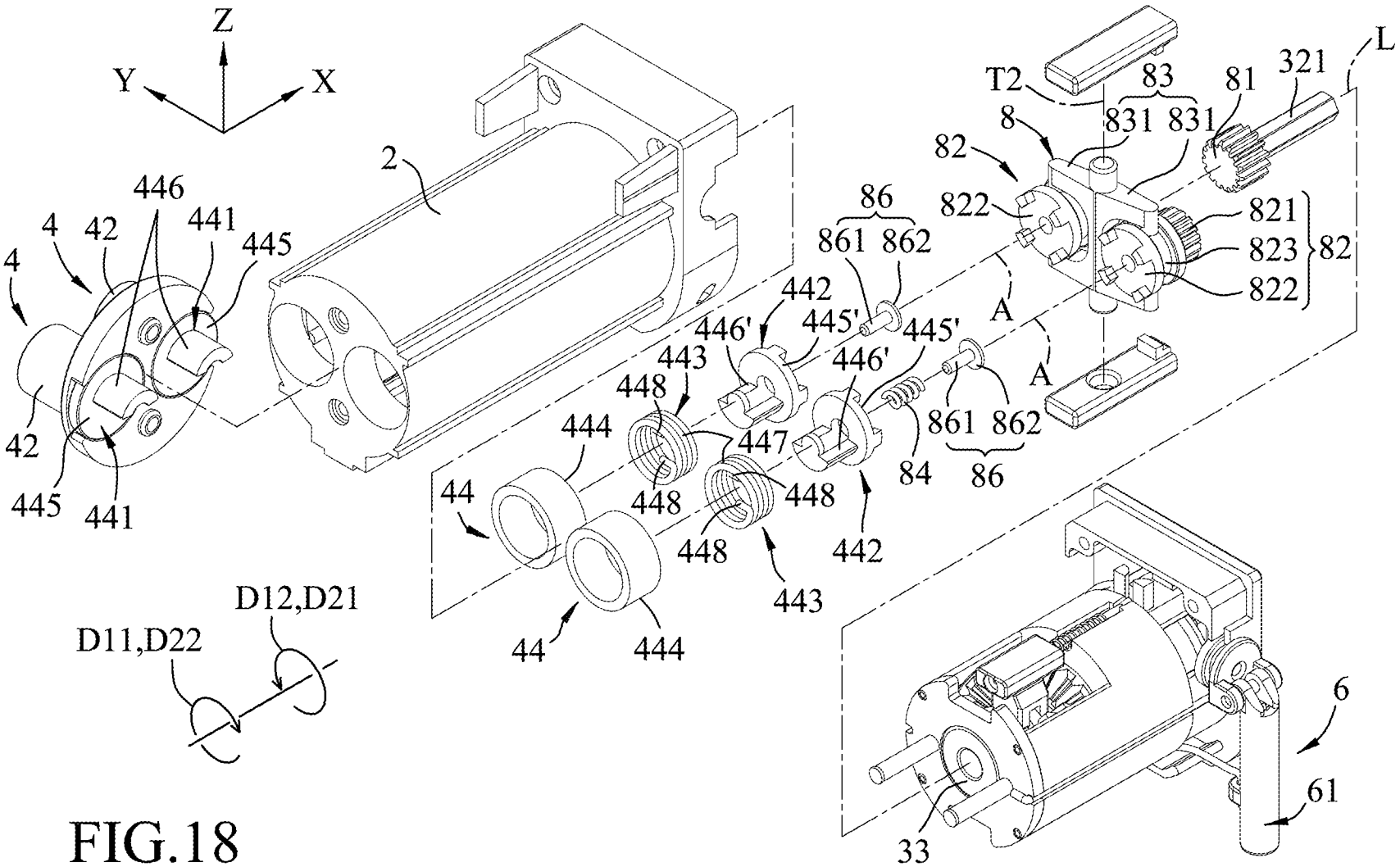
FIG. 18 is a partially exploded perspective view of a controller assembly according to a fourth embodiment of the disclosure.
Figure 19:
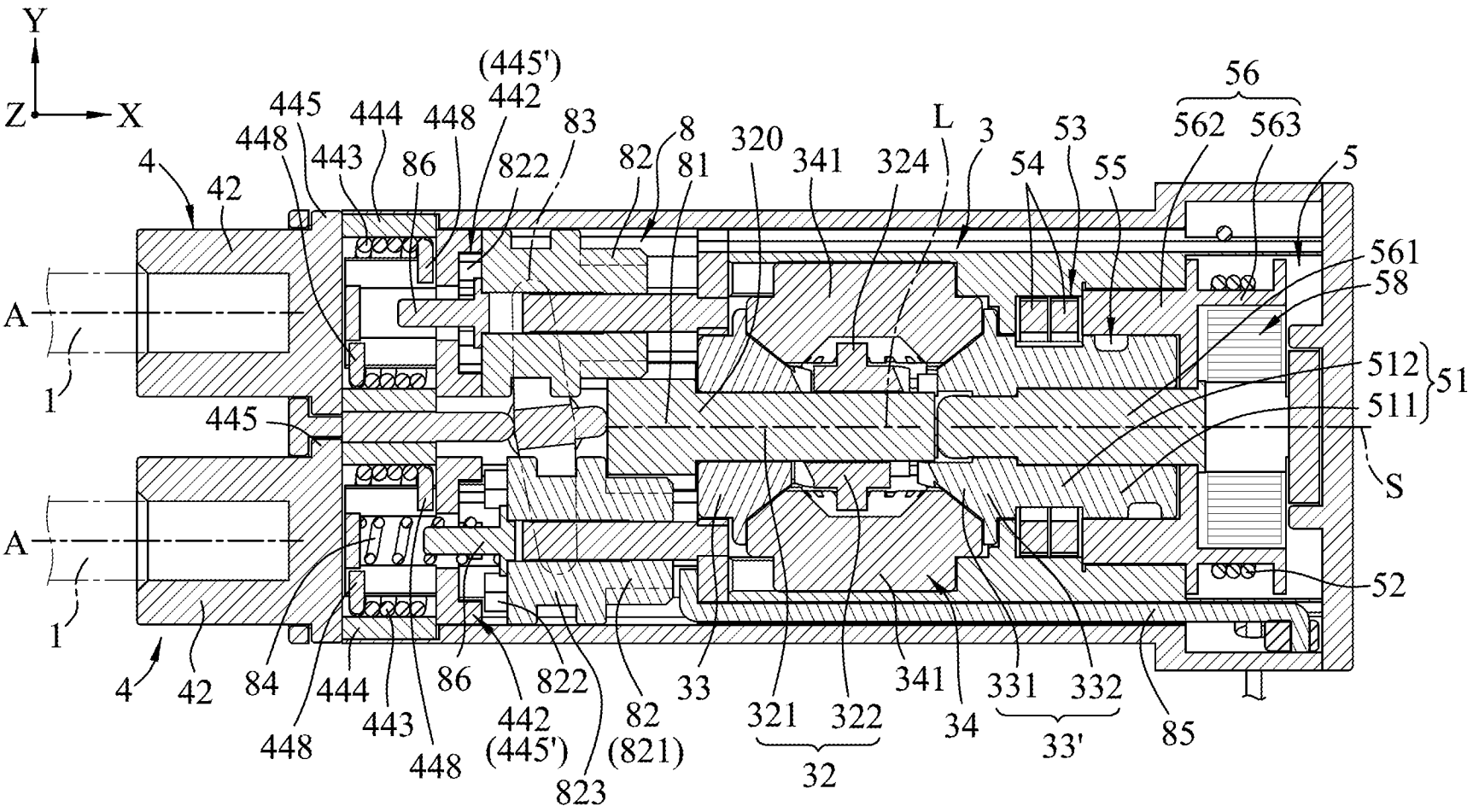
FIG. 19 is a cross-sectional view of the fourth embodiment illustrating a second switch member in a front actuated position.
Figure 20:
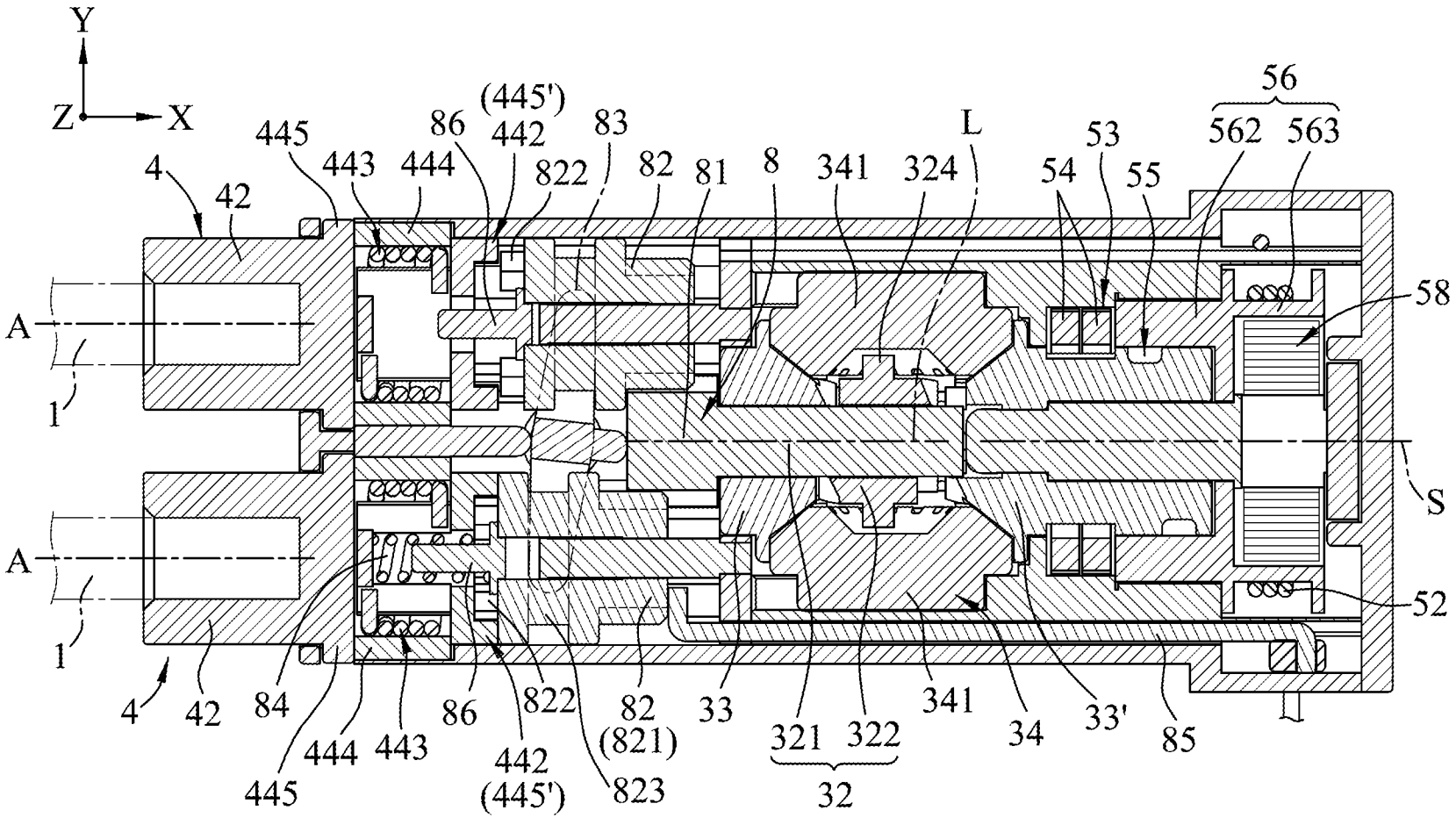
FIG. 20 is similar to FIG. 19 but illustrating the second switch member in a rear actuated position.

FIGS. 18 to 20 illustrate a controller assembly according to a fourth embodiment of the disclosure. In the fourth embodiment, the controller assembly includes a transmission mechanism 3 similar to that of the third embodiment, a drive mechanism 5 similar to that of the second embodiment, two output mechanisms 4 which are juxtaposed in the front-rear direction (Y), and a second switch mechanism 8. Each of the output mechanisms 4 includes a one-way actuator 44 similar to that of the third embodiment and an output sleeve 42 similar to that of the first or second embodiment.

In an embodiment shown in FIGS. 19 and 20, the auxiliary bevel gears 341 may be disposed opposite to each other in the front-rear direction (Y).

In an embodiment shown in FIGS. 19 and 20, the tubular portion 332 of the second major gear 33' may extend leftwardly from the distal portion 512 of the drive mount 51 to permit the unwinding direction (D11) to be the same as the second rotational direction (D22), to thereby allow the second major gear 33' to be driven by the drive mount 51 to rotate only in the second rotational direction (D22).

The second switch mechanism 8 includes a second central gear 81, two second side gears 82, and a second switch member 83.

The second central gear 81 is coupled to the left drive end 320 to rotate with the transmission axle 321 about the longitudinal axis (L).

The second side gears 82 are disposed respectively at front and rear sides of the second central gear 81. Each of the second side gears 82 has a right gear portion 821, a left coupling portion 822, and a middle retained portion 823. The right gear portion 821 is configured to be in mesh with the second central gear 81. The left coupling portion 822 is configured to be detachably coupled to the right end mount 445' of a respective one of the output mechanisms 4 so as to drive rotation of the right actuating member 442 of the respective output mechanism 4. The middle retained portion 823 is disposed between the right gear portion 821 and the left coupling portion 822.

The second switch member 83 has two second retaining portions 831 which are configured to respectively retain the middle retained portions 823 of the second side gears 82. The second switch member 83 is turnable about a second turning axis (T2) which extends in an upright direction (Z) so as to switch between a front actuated position and a rear actuated position. In the front actuated position, as shown in FIG. 19, the left coupling portion 822 of a front one of the second side gears 82 is coupled to the right end mount 445' of a front one of the output mechanisms 4, whilst the left coupling portion 822 of a rear one of the second side gears 82 is detached from the right end mount 445' of a rear one of the output mechanisms 4. In the rear actuated position, as shown in FIG. 20, the left coupling portion 822 of the rear one of the second side gears 82 is coupled to the right end mount 445' of the rear one of the output mechanisms 4, whilst the left coupling portion 822 of the front one of the second side gears 82 is detached from the right end mount 445' of the front one of the output mechanisms 4.

In an embodiment shown in FIGS. 18 to 20, the left end mount 445 and the output sleeve 42 are integrally formed.

In an embodiment shown in FIGS. 18 to 20, the second switch mechanism 8 may further include a second biasing spring 84 and a second actuating member 85.

The second biasing spring 84 is disposed to bias the second switch member 83 to one of the front actuated position and the rear actuated position.

The second actuating member 85 is coupled to drive movement of the second switch member 83 to the other one of the front actuated position and the rear actuated position, against a second biasing force of the second biasing spring 84.

In an embodiment shown in FIGS. 19 and 20, the second actuating member 85 is a rigid control cable.

In an embodiment shown in FIGS. 18 to 20, the second switch mechanism 8 may further include two abutment pins 86 each having a pin body 861 and an enlarged head 862. The pin body 861 of each of the abutment pins 86 is movably retained by the right end mount 445' of a respective one of the output mechanisms 4. The enlarged head 862 of each of the abutment pins 86 is disposed for abutting engagement with the left coupling portion 822 of a respective one of the second side gears 82. The second biasing spring 84 is a coil spring sleeved on the pin body 861 of a rear one of the abutment pins 86 to force the left coupling portion 822 of the rear one of the second side gears 82 away from the right end mount 445' of the rear one of the output mechanisms 4, thereby biasing the second switch member 83 to the front actuated position (FIG. 19).

When the second actuating member 85 is actuated to push the rear one of the second side gears 82 leftwardly, the left coupling portion 822 of the rear one of the second side gears 82 is brought into coupling engagement with the right end mount 445' of the rear one of the output mechanisms 4, and the second switch member 83 is turned about the second turning axis (T2), thereby displacing the second switch member 83 to the rear actuated position (FIG. 20).

In sum, with the provision of the controller assembly of the disclosure, when the transmission unit 32 is coupled to rotate with one of the first and second major gears 33, 33', a window blind may wind up in response to pulling of the pulling cord 52. On the other hand, when the transmission unit 32 is coupled to rotate with the other one of the first and second major gears 33, 33', the window blind may wind down in response to pulling of the pulling cord 52.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A controller assembly for a window blind, comprising:
at least one transmission mechanism including
a gear unit including
a first major gear and a second major gear which are coaxially spaced apart from each other along a longitudinal axis, and
an auxiliary gear set disposed to couple to both said first and second major gears such that when said gear unit is driven to operate, said first and second major gears rotate respectively in a first rotational direction and a second rotational direction which is opposite to the first rotational direction, and
a transmission unit which is selectively coupled to rotate with a selected one of said first and second major gears; and
a drive mechanism including
a spool unit coupled to said at least one transmission mechanism, and
a pulling cord coupled to and wound around said spool unit such that when said pulling cord is actuated to unwind from said spool unit, said gear unit of said least one transmission mechanism is driven to operate.

2. The controller assembly according to claim 1, wherein said transmission unit includes
a transmission axle extending along the longitudinal axis through at least one of said first and second major gears to be coaxial with said first and second major gears, said transmission axle being freely rotatable relative to said first and second major gears, and
a coupling sleeve which is sleeved and retained on said transmission axle to permit said transmission axle to rotate therewith, and which is located between said first and second major gears, said coupling sleeve being actuatable to slide axially between
a first coupling position, where said coupling sleeve is coupled to said first major gear to permit said transmission unit to rotate with said first major gear in the first rotational direction, and
a second coupling position, where said coupling sleeve is coupled to said second major gear to permit said transmission unit to rotate with said second major gear in the second rotational direction.

3. The controller assembly according to claim 2, further comprising a control mechanism which includes
a controller,
a coupling mount coupled to permit said coupling sleeve to move therewith, and
a first actuating member connected between said controller and said coupling mount such that in response to actuation of said controller, said coupling sleeve is driven by said coupling mount to move between the first and second coupling positions.

4. The controller assembly according to claim 2, wherein said drive mechanism further includes
a drive mount coupled to drive operation of said gear unit, and including a proximate portion and a distal portion,
a first biasing spring mounted to said spool unit, and configured to acquire a first biasing force when said pulling cord is unwound from said spool unit, and
a first unidirectional drive unit coupled between said spool unit and said proximate portion of said drive mount, and configured such that
when said pulling cord is unwound from said spool unit to drive rotation of said spool unit in an unwinding direction which extends about a spool axis, said drive mount is driven to rotate with said spool unit in the unwinding direction, and
when said pulling cord is released to permit said spool unit to be driven by the first biasing force to rotate in a winding direction for winding back said pulling cord around said spool unit, said drive mount is prevented from rotating with said spool unit.

5. The controller assembly according to claim 4, further comprising a spool axle extending along the spool axis, wherein said spool unit is retained on and rotatable relative to said spool axle about the spool axis, and includes a spool tube which said pulling cord is coupled to and wound therearound, and a coupling tube having an inner peripheral surface configured to confront said proximate portion of said drive mount;

wherein said first biasing spring is coupled between said spool axle and said spool tube; and wherein said first unidirectional drive unit includes two first ratchet members which are mounted on said proximate portion of said drive mount, and which are spaced apart from each other in a direction of the spool axis to define therebetween a first surrounding groove extending about the spool axis, each of said first ratchet members including a first flange wall extending radially and outwardly from said proximate portion, and a plurality of first teeth which extend from said first flange wall to border said first surrounding groove together with said first flange wall, and which are angularly displaced from each other about the spool axis, each of said first teeth having a first abutment edge and a first guiding edge opposite to said first abutment edge, a plurality of first retaining grooves which are formed in said inner peripheral surface of said coupling tube, and which are angularly displaced from each other about the spool axis, each of said first retaining grooves extending in the direction of the spool axis, and a plurality of first rolling balls which are slidably and respectively retained in said first retaining grooves, and which are rollable in said first surrounding groove such that when said spool unit is driven to rotate in the unwinding direction, each of said first rolling balls is brought into abutting engagement with a corresponding one of said first abutment edges of said first teeth of said first ratchet members to thereby permit said drive mount to rotate with said spool unit, and when said spool unit is driven to rotate in the winding direction, each of said first rolling balls is guided by said first guiding edges of said first teeth of said first ratchet members to roll along said first surrounding groove to thereby prevent said drive mount from rotating with said spool unit.

6. The controller assembly according to claim 4, wherein said drive mechanism further includes a second unidirectional drive unit coupled to said distal portion of said drive mount such that when said spool unit rotates in the unwinding direction, said gear unit is driven by said drive mount to operate, and such that when said spool unit rotates in the winding direction, said gear unit is prevented from being driven by said drive mount to operate.

7. The controller assembly according to claim 6, wherein said second unidirectional drive unit includes a plurality of ratchet teeth which are formed on said distal portion of said drive mount, and which are angularly displaced from each other about the spool axis, each of said ratchet teeth having an engaging edge and a sweeping edge opposite to said engaging edge, and at least one restriction member coupled to be only movable in an upright direction, and formed with a through bore configured to receive said distal portion of said drive mount therein, said restriction member having a pawl disposed in said through hole such that when said spool unit rotates in the unwinding direction, said sweeping edges of said ratchet teeth sweep pass said pawl to permit said drive mount to rotate with said spool unit, thereby allowing said gear unit to be driven by said drive mount to operate, and when said spool unit rotates in the winding direction, said engaging edge of a corresponding one of said ratchet teeth is engaged by said pawl to prevent said drive mount from rotating with said spool unit, thereby preventing said gear unit from being driven by said drive mount to operate.

8. The controller assembly according to claim 6, wherein said second unidirectional drive unit includes two second ratchet members which are mounted on said distal portion of said drive mount, and which are spaced apart from each other in the direction of the spool axis to define therebetween a second surrounding groove extending about the spool axis, each of said second ratchet members including a second flange wall extending radially and outwardly from said distal portion, and a plurality of second teeth which extend from said second flange wall to border said second surrounding groove together with said second flange wall, and which are angularly displaced from each other about the spool axis, each of said second teeth having a second abutment edge and a second guiding edge opposite to said second abutment edge, a tubular case immovably mounted around said distal portion of said drive mount, and having an inner tubular surface formed with a plurality of second retaining grooves which are angularly displaced from each other about the spool axis, each of said second retaining grooves extending in the direction of the spool axis, and a plurality of second rolling balls which are slidably and respectively retained in said second retaining grooves, and which are rollable in said second surrounding groove such that when said spool unit is driven to rotate in the unwinding direction, each of said second rolling balls is brought into abutting engagement with a corresponding one of said second abutment edges of said second teeth of said second ratchet members to permit said drive mount to rotate with said spool unit, thereby allowing said gear unit to be driven by said drive mount to operate, and when said spool unit is driven to rotate in the winding direction, each of said second rolling balls is guided by said second guiding edges of said second teeth of said second ratchet members to roll along said second surrounding groove to prevent said drive mount from rotating with said spool unit, thereby preventing said gear unit from being driven by said drive mount to operate.

9. The controller assembly according to claim 6, wherein each of said first and second major gears includes a plurality of inner mating teeth and a plurality of outer bevel teeth;

wherein said auxiliary gear set includes at least one auxiliary bevel gear which is in mesh simultaneously with said outer bevel teeth of said first and second major gears so as to permit said first and second major gears to rotate respectively in the first and second rotational directions; and wherein said coupling sleeve has a first coupling end formed with a plurality of first mating teeth which are configured such that when said coupling sleeve is in the first coupling position, said first mating teeth are in mesh with said inner mating teeth of said first major gear to permit said coupling sleeve and said transmission axle to rotate with said first major gear, and a second coupling end opposite to said first coupling end and formed with a plurality of second mating teeth which are configured such that when said coupling sleeve is in the second coupling position, said second mating teeth are in mesh with said inner mating teeth of said second major gear to permit said coupling sleeve and said transmission axle to rotate with said second major gear.

10. The controller assembly according to claim 9, wherein the longitudinal axis is transverse to the spool axis, and said auxiliary bevel gear includes a central portion extending from said distal portion of said drive mount so as to permit said auxiliary bevel gear to be driven by said drive mount to rotate about the spool axis, and a plurality of auxiliary bevel teeth which are angularly displaced from each other about said central portion, and which are in mesh simultaneously with said outer bevel teeth of said first and second major gears to thereby drive rotations of said first and second major gears.

11. The controller assembly according to claim 9, wherein each of the longitudinal axis and the spool axis extends in a left-right direction;

wherein each of said first and second major gears includes a tubular portion and a wheel portion which is opposite to said tubular portion in the left-right direction, and which has said inner mating teeth and said outer bevel teeth, said first major gear being disposed leftward of said second major gear to permit said wheel portions of said first and second major gears to be arranged to confront each other; and wherein said tubular portion of said second major gear is coupled to be driven by said drive mount when said spool unit is driven to rotate in the unwinding direction.

12. The controller assembly according to claim 11, which comprises two of said transmission mechanisms that are juxtaposed in a front-rear direction, said controller assembly further comprising a first switch mechanism which is configured to permit said distal portion of said drive mount to selectively couple to said second major gear of a selected one of said transmission mechanisms to thereby drive operation of said gear unit of said selected one of said transmission mechanisms.

13. The controller assembly according to claim 12, wherein said first switch mechanism includes a first central gear coupled to said distal portion of said drive mount such that when said spool unit rotates in the unwinding direction, said first central gear is driven to rotate with said drive mount, two first side gears disposed respectively at front and rear sides of said first central gear, each of said first side gears having a plurality of first gear teeth configured to be in mesh with said first central gear, and a leftward coupling portion configured to be detachably coupled to said tubular portion of said second major gear of a respective one of said transmission mechanisms so as to drive rotation of said second major gear of said respective transmission mechanism, and a first switch member having two first retaining portions which are configured to respectively retain said first side gears, said first switch member being turnable about a first turning axis which extends in an upright direction so as to switch between a first actuated position, where said leftward coupling portion of a front one of said first side gears is coupled to said tubular portion of said second major gear of a front one of said transmission mechanisms whilst said leftward coupling portion of a rear one of said first side gears is detached from said tubular portion of said second major gear of a rear one of said transmission mechanisms, and a second actuated position, where said leftward coupling portion of the rear one of said first side gears is coupled to said tubular portion of said second major gear of the rear one of said transmission mechanisms whilst said leftward coupling portion of the front one of said first side gears is detached from said tubular portion of said second major gear of the front one of said transmission mechanisms.

14. The controller assembly according to claim 13, wherein each of said transmission mechanisms further includes a third unidirectional drive unit coupled to permit said second major gear to rotate only in the second rotational direction.

15. The controller assembly according to claim 11, wherein said drive mount has a left end which is disposed leftward of said distal portion, and which is in splined engagement with said tubular portion of said second major gear to permit the unwinding direction to be the same as the second rotational direction, to thereby allow said second major gear to be driven by said drive mount to rotate only in the second rotational direction.

16. The controller assembly according to claim 11, wherein said tubular portion of said second major gear extends leftwardly from said distal portion of said drive mount to permit the unwinding direction to be the same as the second rotational direction, to thereby allow said second major gear to be driven by said drive mount to rotate only in the second rotational direction.

17. The controller assembly according to claim 11, wherein said transmission axle extends through said first major gear to terminate at a left drive end, said controller assembly further comprising at least one output mechanism which includes a one-way actuator that defines an actuating axis in the left-right direction, and that includes a left actuating member having a left end mount, and a first curved piece which extends from a right surface of said left end mount, and which extends about the actuating axis to terminate at two first actuating edges;

a right actuating member having a right end mount which is coupled to be driven by said left drive end to rotate about the actuating axis, and which is spaced apart from said left end mount in the left-right direction, and a second curved piece which extends from a left surface of said right end mount, and which extends about the actuating axis to terminate at two second actuating edges, each of said second actuating edges being angularly displaced from a respective one of said first actuating edges about the actuating axis, a sleeve member configured to accommodate said first and second curved pieces therein, and a coil spring having a spring body configured to surround said first and second curved pieces, and compressedly disposed inside said sleeve member, and two spring ends each having a wind-up edge and a wind-down edge, said wind-up edges of said spring ends being disposed to respectively confront said second actuating edges of said second curved piece, said wind-down edges of said spring ends being disposed to respectively confront said first actuating edges of said first curved piece such that when said right actuating member is driven by said left drive end to rotate, one of said second actuating edges is brought into abutment with a corresponding one of said wind-up edges to permit said spring body to be tightened to have an outer dimension less than an inner dimension of said sleeve member, thereby allowing said first curved piece together with said left end mount to be driven by said second curved piece to rotate about the actuating axis, and when said left actuating member is forced to drive rotation of said right actuating member, one of said first actuating edges is brought into abutment with a corresponding one of said wind-down edges to permit said spring body to be expanded into frictional contact with an inner peripheral surface of said sleeve member, thereby preventing said right actuating member from being driven by said left actuating member to rotate.

18. The controller assembly according to claim 17, wherein the longitudinal axis is in line with the actuating axis, and said left drive end of said transmission axle is in splined engagement with said right end mount of said right actuating member so as to permit said right actuating member to be driven by said transmission axle to rotate, said output mechanism further including a sun gear mounted on a left surface of said left end mount to rotate with said left actuating member about the actuating axis, a carrier web disposed leftward of said left end mount, and having a central hole configured for extension of said sun gear therethrough, a ring gear immovably retained around said sun gear, a plurality of planet gears which are rotatably mounted on said carrier web, and which are angularly displaced from each other about the actuating axis, each of said planet gears being configured to mesh with both of said sun gear and said ring gear such that when said sun gear is driven to rotate with said left actuating member, said planet gears are driven to rotate about said sun gear, thereby driving rotation of said carrier web at a slower speed than said left actuating member, and an output sleeve coupled to rotate with said carrier web.

19. The controller assembly according to claim 17, which comprises two of said output mechanisms that are juxtaposed in a front-rear direction, said controller assembly further comprising a second switch mechanism including a second central gear coupled to said left drive end to rotate with said transmission axle about the longitudinal axis, two second side gears disposed respectively at front and rear sides of said second central gear, each of said second side gears having a right gear portion configured to be in mesh with said second central gear, a left coupling portion configured to be detachably coupled to said right end mount of a respective one of said output mechanisms so as to drive rotation of said right actuating member of said respective output mechanism, and a middle retained portion disposed between said right gear portion and said left coupling portion, and a second switch member having two second retaining portions which are configured to respectively retain said middle retained portions of said second side gears, said second switch member being turnable about a second turning axis which is in an upright direction so as to switch between a front actuated position, where said left coupling portion of a front one of said second side gears is coupled to said right end mount of a front one of said output mechanisms, whilst said left coupling portion of a rear one of said second side gears is detached from said right end mount of a rear one of said output mechanisms, and a rear actuated position, where said left coupling portion of the rear one of said second side gears is coupled to said right end mount of the rear one of said output mechanisms, whilst said left coupling portion of the front one of said second side gears is detached from said right end mount of the front one of said output mechanisms.

20. The controller assembly according to claim 19, wherein said second switch mechanism further includes a second biasing spring disposed to bias said second switch member to one of the front actuated position and the rear actuated position, and a second actuating member coupled to drive movement of said second switch member to the other one of the front actuated position and the rear actuated position, against a second biasing force of said second biasing spring.

* * * * *